US007530660B2

(12) United States Patent
Yamanobe

(10) Patent No.: US 7,530,660 B2
(45) Date of Patent: May 12, 2009

(54) DROPLET DEPOSITION POSITION ERROR MEASUREMENT METHOD, DROPLET DEPOSITION POSITION ERROR ADJUSTMENT METHOD, DROPLET EJECTION CONTROL METHOD, AND IMAGE FORMING APPARATUS

(75) Inventor: Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 320 days.

(21) Appl. No.: 11/492,767

(22) Filed: Jul. 26, 2006

(65) Prior Publication Data

US 2007/0024663 A1 Feb. 1, 2007

(30) Foreign Application Priority Data

Jul. 27, 2005 (JP) ..... 2005-217537

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 6,547,360 B2 * 4/2003 Takahashi et al. ..... 347/19
6,629,747 B1 * 10/2003 King et al. ..... 347/19

FOREIGN PATENT DOCUMENTS

JP 11277721 A 10/1999
JP 2001129983 A 5/2001

* cited by examiner

*Primary Examiner*—Luu Matthew
*Assistant Examiner*—Justin Seo
(74) *Attorney, Agent, or Firm*—Birch, Stewart, Kolasch & Birch, LLP

(57) ABSTRACT

The droplet deposition position error measurement method, comprises the steps of: ejecting liquid droplets from a liquid ejection head including a plurality of liquid droplet ejection ports in such a manner that the liquid droplets are deposited on a recording medium; determining an amount of a droplet deposition position error with respect to an ideal droplet deposition position on a recording surface of the recording medium, according to a droplet deposition result obtained from the liquid droplets on the recording medium; separating a first error component caused by an error in a relative position between the liquid ejection head and the recording medium, and a second error component caused by an error in an ejection direction of each of the liquid droplet ejection ports, from the determined amount of the droplet deposition position error; and obtaining error information relating to at least one of the first and second error components.

13 Claims, 14 Drawing Sheets

NORMAL METHOD (NO CORRECTION)

CORRECTED CASE

DROPLET DEPOSITION POSITION ERROR MEASUREMENT METHOD, DROPLET DEPOSITION POSITION ERROR ADJUSTMENT METHOD, DROPLET EJECTION CONTROL METHOD, AND IMAGE FORMING APPARATUS

BACKGROUND OF THE INVENTION

1. Field of the Invention

The present invention relates to a droplet deposition position error measurement method, a droplet deposition position error adjustment method, a droplet ejection control method and an image forming apparatus, and more particularly, to a droplet deposition position error adjustment method suitable to an inkjet recording apparatus which forms an image by ejecting droplets of ink onto a recording medium from a print head in which a plurality of ink ejection ports (nozzles) are formed, and an adjustment method and a droplet ejection control method for correcting such an error, and an image forming apparatus using this droplet ejection control method.

2. Description of the Related Art

In an inkjet recording apparatus (an inkjet printer) comprising a print head having a plurality of nozzles, if the print head is installed at angle of inclination with respect to the prescribed installation position (the ideal installation position according to the design), then dots are not formed at the desired positions, and hence there is a problem in that the recording positions (droplet deposition (landing) positions) of the dots are displaced.

In view of the aforementioned problem, Japanese Patent Application Publication No. 11-277721 discloses a method in which, in order to determine the degree to which a print head is inclined with respect to the recording paper conveyance direction, a plurality of line patterns of a length in which a plurality of ink ejection ports are aligned are printed, the print results of this plurality of line patterns are determined visually, and the installation position of the print head is adjusted.

Furthermore, Japanese Patent Application Publication No. 2001-129983 discloses a structure of a carriage section which is capable of adjusting the inclination of the head, having a composition in which the inclination of the head is adjusted on the basis of a correlation between the results of the test recording and a previously determined inclination correction amount.

Japanese Patent Application Publication No. 11-277721 and Japanese Patent Application Publication No. 2001-129983 both have technical contents based on the serial scanning type of inkjet recording apparatus which records images while reciprocally moving a print head in a direction perpendicular to the direction of conveyance of the recording paper (the sub-scanning direction).

The droplet deposition position error caused by the inclination of the recording head was studied in more detail, and then in addition to the problems disclosed in Japanese Patent Application Publication No. 11-277721 and Japanese Patent Application Publication No. 2001-129983-(namely, jaggedness of the printed lines due to displacement of the dot positions between scans in the serial scanning method), there are also problems of the following kind, especially in a case where the nozzles are arranged at high density.

(1) Banding (Unevenness) Occurring at the Return Positions in a Matrix Head

In an inkjet recording apparatus, in order to print images of high quality at high speed, a recording head having a plurality of nozzles arranged in a two-dimensional matrix (so-called "matrix head") have been proposed. If droplets are ejected from a matrix head of this kind, and if the head is installed in an inclined fashion, then the pitch between the nozzles from which droplets are ejected to form mutually adjacent dots on the recording medium varies, and banding may occur at the regions corresponding to the return positions of the matrix configuration (hereinafter, this banding is also called "matrix return position banding"). This phenomenon is illustrated in FIG. 13.

FIG. 13 is a plan view perspective diagram showing a schematic view of a portion of a matrix head. The left-hand diagram in FIG. 13 shows a case where a matrix head is installed correctly, and the right-hand diagram in FIG. 13 shows a case where the matrix head is installed in a position rotated in the counter-clockwise direction, in the plane of the paper. In FIG. 13, reference numeral 210 denotes a nozzle and reference numeral 212 denotes a pressure chamber corresponding to each nozzle.

Each pressure chamber 212 corresponding to a nozzle 210 is coupled to a common flow channel for ink supply (not shown) via an independent supply port (not shown), in such a manner that ink is filled into each pressure chamber 212 from the common flow channel. Furthermore, pressure generating elements (for example, piezoelectric elements) (not shown) are provided corresponding to the pressure chambers 212, and hence ink droplets can be ejected from the nozzles 210 by controlling the driving of the pressure generating elements in accordance with the print data. By controlling the ink ejection timings of the nozzles 210 while the recording medium is conveyed, it is possible to record a desired image on the recording medium.

As shown in the left-hand diagram in FIG. 13, if the matrix head is installed correctly, then the dots recorded onto the recording medium are arranged at equidistant intervals in the main scanning direction. On the other hand, as shown in the right-hand diagram in FIG. 13, if the matrix head has been installed at a position rotated in the count-clockwise direction, in the plane of the paper, then the dot interval corresponding to each return position of the matrix arrangement widens markedly compared to the other positions (see B1 in FIG. 13). Therefore, banding occurs with respect to each of the return positions in the matrix arrangement. In the description given below, a group of nozzles corresponding to each return position in the matrix arrangement (a nozzle group as indicated by C in FIG. 13) is called a "nozzle block".

(2) Banding Occurring at Joint Sections Between Short Heads

In cases where a line head is constituted by joining together a plurality of short head modules (short heads), if the positions of the joints between the short heads are displaced, then the pitches between the nozzles from which droplets are ejected to form mutually adjacent dots vary, and banding occurs at the regions corresponding to the joint sections between the short heads (below, this type of banding is also called "short head joint banding"). This phenomenon is illustrated in FIGS. 14A and 14B.

FIG. 14A shows a case where the short heads 221 and 222 are installed correctly, and the dots recorded onto the recording medium are arranged at equidistant intervals in the main scanning direction. On the other hand, FIG. 14B shows a case where the short heads 221 and 222 are installed in positions where they are distanced from each other (namely, the right-hand short head is shifted in the rightward direction from the normal installation position, in the diagram). In this case, the dot interval at a joint section between the short heads is widened markedly in comparison with the other dot intervals (see B2 in FIG. 14B). Consequently, banding occurs at the junction between the short heads.

Next, the reasons why the dots are caused to be displaced from their desired positions are explained. The causes of displacement of the dot positions include errors that are intrinsic to the nozzles, in addition to an error caused by incorrect installation of the head as described above. Intrinsic nozzle errors are caused by soiling in the vicinity of the nozzle (a non-uniform lyophobic state), or manufacturing errors in the nozzle section, or the like, and consequently the liquid droplets ejected from the nozzles are displaced from the desired ejection direction (which is normally, the perpendicular direction with respect to the nozzle surface). Usually, these errors are thought to occur independently at each nozzle (in other words, it is thought that there is no correlation between nozzles).

Intrinsic nozzle errors may also be involve an error which does not create a shift in the ejection direction (for example, an error caused by a nozzle hole being formed in a place that is displaced from the desired position, in the manufacturing stage); however, with current manufacturing technology, this hardly ever happens, and therefore an intrinsic nozzle error is principally due to an error involving displacement of the ejection direction. Therefore, in the following description, reference to an intrinsic nozzle error is taken to be an error in terms of displacement of the ejection direction of a nozzle itself.

According to Japanese Patent Application Publication No. 11-277721 and Japanese Patent Application Publication No. 2001-129983 described above, the amount of displacement in the installation of the head is estimated by actually performing a test print; however, in these methods, it is difficult to distinguish between an error caused by incorrect installation of the head, and an error that is intrinsic to the nozzles. Hence these methods are not suitable for a case where a head position is sought to be adjusted precisely according to a test pattern.

In particular, in order to prevent "matrix return position banding" or "short head joint banding", if the position of the head is adjusted according to a test pattern, then the amount of displacement of the dot positions that are to be measured is of the order of several μm, and this is the same order as that of the positional error that is intrinsic to the nozzles. Therefore, it is difficult to evaluate the amount of adjustment (the amount of correction) of the head position accurately, on the basis of the measured values of the amount of displacement of the dot positions.

SUMMARY OF THE INVENTION

The present invention is contrived in view of the foregoing circumstances, an object thereof being to provide a droplet deposition position error measurement method, a droplet deposition position error adjustment method, a droplet ejection control method, and an image forming apparatus, whereby a droplet deposition position can be adjusted (corrected) more accurately, by distinguishing between a droplet deposition position error caused by incorrect installation of the head or the like, and a droplet deposition position error caused by an intrinsic nozzle error (namely, an error caused by displacement of the ejection direction of a nozzle itself).

In order to attain the aforementioned object, the present invention is directed to a droplet deposition position error measurement method, comprising the steps of: ejecting liquid droplets from a liquid ejection head including a plurality of liquid droplet ejection ports in such a manner that the liquid droplets are deposited on a recording medium; determining an amount of a droplet deposition position error with respect to an ideal droplet deposition position on a recording surface of the recording medium, according to a droplet deposition result obtained from the liquid droplets on the recording medium; separating a first error component caused by an error in a relative position between the liquid ejection head and the recording medium, and a second error component caused by an error in an ejection direction of each of the liquid droplet ejection ports, from the determined amount of the droplet deposition position error; and obtaining error information relating to at least one of the first and second error components.

According to this aspect of the present invention, the error (droplet deposition position error) from an ideal droplet deposition position is identified by ascertaining an actual droplet deposition position on the recording medium, on the basis of the result of the droplet ejection onto the recording medium. The error measured in this way includes a first error component caused by an error in the relative position of the head and the recording medium, and a second error component caused by an error in the ejection direction, which is intrinsic to a nozzle (liquid droplet ejection port). Consequently, by performing a plurality of measurements and determinations under different conditions and combining the information thus obtained, the first error component and the second error component can be separated, and the error caused by each cause (i.e., each of the first error component and the second error component) can then be evaluated.

By using the error value relating to each cause obtained in this way, it is possible to carry out effective adjustment for correcting the error in the relative position of the head and the recording medium, and correction for suppressing deterioration of image quality due to an error in the ejection direction.

Modes of an error in the relative position between the liquid ejection head and the recording medium include an error in the installation position of the head (installation error), and an error due to the skewed travel or meandering travel caused by an error in the conveyance of the recording medium conveyance system (conveyance apparatus positioning error).

A print determination device (for example, a CCD scanner), equipped with an image sensor (an imaging element such as a line sensor or area sensor) for capturing the print results of a test print (or actual print) can be used for measuring the amount of droplet deposition position error. The test pattern is read in by the print determination device, the image signal thus obtained is analyzed (processed), and the amount of displacement from the ideal droplet deposition position can be determined.

Desirably, a recording medium for measurement is a medium having weak bleeding characteristics, (for example, a medium having a porous image receiving layer, or special inkjet photographic paper). If a medium of this kind is used, then a clean dot shape is reproduced on the medium, and therefore the accuracy of the positional error measurement is improved.

Alternatively, a mode is also possible in which the actual conveyance belt used to hold and convey the recording medium is also used as the medium. In other words, a mode is also possible in which the test pattern is printed directly onto the conveyance belt. In this case, in addition to the merit of avoiding wasteful consumption of media, the following benefits can be also obtained.

In a mode in which a test pattern is printed on the conveyance belt, the flight distance of an ejected droplet becomes the longest distance, and hence the amount of droplet deposition position displacement caused by the oblique flight also increases (the flight distance is shortened by the thickness of the medium when a medium for test printing is mounted on the conveyance belt, and therefore, the distance between the ejection surface and the medium is a maximum when printing is performed onto a conveyance belt on which no medium is mounted). Consequently, the measurement of the amount of droplet deposition position error by the print determination unit is facilitated. Furthermore, in the case of a composition in which a print determination device is installed in a prescribed position of the apparatus, since the observation distance of the sensor of the print determination device is a fixed value (namely, the distance between the sensor and the belt is a fixed value), then the optical sensor in the print determination device may have a shallow focal depth.

It is also possible to use a measurement device which measures distance by means of a pulse laser, for example, for the measurement of the distance between the nozzle surface and the medium. Furthermore, information on the thickness of the medium may be supplied via a user interface.

In order to attain the aforementioned object, the present invention is also directed to a droplet deposition position error measurement method, comprising the steps of: ejecting liquid droplets from a liquid ejection head including a plurality of liquid droplet ejection ports, toward a first recording medium situated at a first distance from an ejection surface of the liquid ejection head in such a manner that the liquid droplets are deposited on the first recording medium; determining an amount of a first droplet deposition position error with respect to an ideal droplet deposition position on a recording surface of the first recording medium, according to a droplet deposition result obtained from the liquid droplets on the first recording medium; ejecting liquid droplets from the liquid ejection head toward a second recording medium situated at a second distance, which is different from the first distance, from the ejection surface in such a manner that the liquid droplets are deposited on the second recording medium; determining an amount of a second droplet deposition position error with respect to an ideal droplet deposition position on a recording surface of the second recording medium, according to a droplet deposition result obtained from the liquid droplets on the second recording medium; and performing calculation for separating a first error component caused by errors in relative positions between the liquid ejection head and each of the first and second recording media, and a second error component caused by an error in an ejection direction of each of the liquid droplet ejection ports, from the determined amounts of first and second droplet deposition position errors; and obtaining error information relating to at least one of the first and second error components.

According to this aspect of the present invention, droplets are ejected a plurality of times at different distances between the ejection surface of the liquid ejection head and the recording surface, and hence it is possible to readily separate the cause of an error from the droplet deposition result.

In order to attain the aforementioned object, the present invention is also directed to a droplet deposition position error measurement method, comprising the steps of: ejecting liquid droplets from a liquid ejection head including a plurality of liquid droplet ejection ports in such a manner that the liquid droplets are deposited on a recording medium; determining an amount of a droplet deposition position error with respect to an ideal droplet deposition position on a recording surface of the recording medium, according to a droplet deposition result obtained from the liquid droplets on the recording medium; measuring an ejection direction of the liquid droplet ejected from each of the liquid droplet ejection ports; separating a first error component caused by an error in a relative position between the liquid ejection head and the recording medium, and a second error component caused by an error in the ejection direction of each of the liquid droplet ejection ports, from the determined amount of the droplet deposition position error, according to information on the measured ejection direction; and obtaining error information relating to at least one of the first and second error components.

According to this aspect of the present invention, the error (droplet deposition position error) from an ideal droplet deposition position is identified by ascertaining an actual droplet deposition position on the recording medium, on the basis of the result of droplet ejection onto the recording medium. The error measured in this way includes a first error component caused by an error in the relative position of the head and the recording medium, and a second error component caused by an error in the ejection direction, which is intrinsic to a nozzle (liquid droplet ejection port). By ascertaining the ejection direction (flight direction) of a liquid droplet by observing a state where the liquid droplet have been ejected from a liquid droplet ejection port, or the like, then it is possible to identify the droplet deposition position error (second error component) caused by an error in the ejection direction of each of the liquid droplet ejection ports, on the basis of the ascertained ejection angle. Therefore, it is possible to identify the first error component caused by an error in the relative position between the liquid ejection head and the recording medium, according to the information relating to the second error component and the information relating to the droplet deposition position error (error with respect to the ideal droplet deposition position) measured on the basis of the droplet deposition result.

In order to attain the aforementioned object, the present invention is also directed to a droplet deposition position error adjustment method, comprising the steps of: obtaining error information relating to a first error component according to the above droplet deposition position error measurement method; and adjusting the relative position between the liquid ejection head and the recording medium according to the obtained error information relating to the first error component in such a manner that the first error component is corrected.

According to this aspect of the present invention, for example, the head installation position is adjusted in order to correct the head installation error, and the position of the conveyance apparatus is adjusted in order to correct the conveyance error of the recording medium conveyance system. Accordingly, it is possible to correct an error caused by an improper relative position, accurately.

In order to attain the aforementioned object, the present invention is also directed to a droplet ejection control method, comprising the steps of: obtaining error information relating to a second error component according to the above droplet deposition position error measurement method; and controlling liquid ejection by the liquid ejection head according to the obtained error information relating to the second error component in such a manner that visibility of unevenness on a recorded image caused by the second error component is reduced.

According to this aspect of the present invention, the droplet deposition position error component (second error component) caused by an error in the ejection direction is accurately ascertained and the droplet ejection arrangement (dot arrangement) is corrected from the viewpoint of suppressing the occurrence of the unevenness (e.g., banding, or the like) caused by the error in the ejection direction. Therefore, it is possible to achieve high-quality image formation.

For example, droplet ejection arrangement (dot arrangement) data can be obtained by correcting the image data from the viewpoint of suppressing the occurrence of the unevenness caused by the second error component, on the basis of the information relating to the second error component, and by then performing halftoning of the corrected data. By controlling droplet ejection performed by the liquid ejection head in accordance with the droplet ejection arrangement data, it is possible to achieve satisfactory image formation.

In order to attain the aforementioned object, the present invention is also directed to an image forming apparatus, comprising: a liquid ejection head in which a plurality of liquid droplet ejection ports are formed; a droplet ejection control device which implements control for causing liquid droplets to be ejected from the liquid ejection head in such a manner that the liquid droplets are deposited on a recording medium; a droplet deposition position error measurement device which reads in positions of dots recorded on the recording medium, and determines an amount of a droplet deposition position error with respect to an ideal droplet deposition position on a recording surface of the recording medium; an error cause separation device which separates a first error component caused by an error in a relative position between the liquid ejection head and the recording medium, and a second error component caused by an error in an ejection direction of each of the liquid droplet ejection ports, from the amount of the droplet deposition position error determined by the droplet deposition position error measurement device; an adjustment amount calculation device which calculates an amount of adjustment for the relative position between the liquid ejection head and the recording medium in such a manner that the first error component is corrected, according to error information relating to the first error component separated by the error cause separation device; and a position adjustment device which adjusts the relative position between the liquid ejection head and the recording medium according to the amount of adjustment calculated by the adjustment amount calculation device.

In order to attain the aforementioned object, the present invention is also directed to an image forming apparatus, comprising: a liquid ejection head in which a plurality of liquid droplet ejection ports are formed; a droplet ejection control device which implements control for causing liquid droplets to be ejected from the liquid ejection head in such a manner that the liquid droplets are deposited on a recording medium; a droplet deposition position error measurement device which reads in positions of dots recorded on the recording medium, and determines an amount of a droplet deposition position error with respect to an ideal droplet deposition position on a recording surface of the recording medium; an error cause separation device which separates a first error component caused by an error in a relative position between the liquid ejection head and the recording medium, and a second error component caused by an error in an ejection direction of each of the liquid droplet ejection ports, from the amount of the droplet deposition position error determined by the droplet deposition position error measurement device; a droplet ejection arrangement determination device which determines a droplet ejection arrangement to be performed by the liquid ejection head, according to error information relating to the second error component separated by the error cause separation device, in such a manner that visibility of unevenness on a recorded image caused by the second error component is reduced.

Preferably, the image forming apparatus, further comprises an ejection direction measurement device which measures the ejection direction of the liquid droplet ejected from each of the liquid droplet ejection ports, wherein the error cause separation device performs calculation for separating the first error component and the second error component, from the amount of the droplet deposition position error determined by the droplet deposition position error measurement device, by using information relating to the ejection direction measured by the ejection direction measurement device.

The inkjet recording apparatus according to one mode of the above image forming apparatus comprises: a liquid ejection head (a "recording head") having a liquid droplet ejection element row in which a plurality of liquid droplet ejection elements are arranged in a row, each liquid droplet ejection element including a nozzle for ejecting an ink droplet in order to form a dot and a pressure generating device (e.g., piezoelectric element, heating element, or the like) which generates an ejection pressure; and an ejection control device which controls the ejection of liquid droplets from the recording head on the basis of droplet ejection arrangement data generated from the image data. An image is formed on a recording medium by means of the liquid droplets ejected from the nozzles.

One compositional embodiment of a recording head is a full line type head in which a plurality of nozzles are arranged through a length corresponding to the full width of the recording medium. In this case, a mode may be adopted in which a plurality of relatively short recording head modules having nozzles rows which do not reach a length corresponding to the full width of the recording medium are combined and joined together, thereby forming nozzle rows of a length that corresponds to the full width of the recording medium.

A full line type head is usually disposed in a direction that is perpendicular to the relative feed direction (relative conveyance direction) of the recording medium; however, a mode may also be adopted in which the recording head is disposed following an oblique direction that forms a prescribed angle with respect to the direction perpendicular to the conveyance direction.

A "recording medium" is a medium onto which the liquid ejected from the liquid ejection head (recording head) is deposited, and it receives an image recorded by the action of the recording head. More specifically, the "recording medium" is also called a print medium, image forming medium, image receiving medium, ejection receiving medium, or the like. This "recording medium" includes various types of media, irrespective of material and size, such as continuous paper, cut paper, sealed paper, resin sheets such as OHP sheets, film, cloth, a printed circuit board on which a wiring pattern, or the like, is formed, and an intermediate transfer medium, and the like.

The "conveyance device" may include a mode where the recording medium is conveyed with respect to a stationary (fixed) recording head, a mode where a recording head is moved with respect to a stationary recording medium, or a mode where both the recording head and the recording medium are moved.

When a color image is formed by means of an inkjet head, it is possible to provide a recording head for each color of a plurality of colored inks (recording liquids), and it is also possible to eject inks of a plurality of colors, from one recording head.

Furthermore, a head according to embodiments of the present invention is not limited to a full line head, and embodiments of the present invention may also be applied to a shuttle scanning type recording head (a recording head which ejects droplets while moving reciprocally in a direction substantially perpendicular to the conveyance direction of the recording medium).

According to the present invention, a first error component caused by an error in the relative position between the liquid ejection head and the recording medium, and a second error component caused by an error in the ejection direction of each of the liquid droplet ejection ports, are separated, and accordingly it is possible to acquire error information due to each error. Accordingly, it is possible to achieve the adjustment of the apparatus and the droplet ejection control properly, and hence high-quality image formation is possible.

BRIEF DESCRIPTION OF THE DRAWINGS

The nature of this invention, as well as other objects and benefits thereof, are explained in the following with reference to the accompanying drawings, in which like reference characters designate the same or similar parts throughout the figures and wherein.

DETAILED DESCRIPTION OF THE PREFERRED EMBODIMENTS

Principles of Measurement

Firstly, the principles of the measurement of a droplet deposition position error according to the embodiments of the present invention are described. In the following description, "X0" represents the ideal position, in the main scanning direction, of a dot recorded onto the recording medium, and "X" represents the actual position. Furthermore, "δXH" represents the error caused by incorrect installation of the head, "δXD" represents the error caused by displacement of the ejection direction of the actual nozzle, and the following relationship is assumed.

$$X=X0+\delta XH+\delta XD \quad \text{(Formula 1)}$$

In the calculation, the following relationship is expediently used: ΔX=X−X0.

In the measurement procedure, firstly, a prescribed test pattern is printed. The test pattern to be printed may be based on one dot from each nozzle. Since the issue of positional error in the main scanning direction is to be addressed, as described above, it is also possible to form a dot row (line) in a direction parallel to the sub-scanning direction, by performing ejection consecutively from each of the nozzles.

Then, the positions X of the dots ejected in the test pattern are measured by an image reading apparatus, such as a scanner. FIGS. 1A and 1B and FIGS. 2A and 2B show embodiments of graphs which indicate the relationship between the ideal droplet deposition positions of liquid droplets ejected from respective nozzles (corresponding to the "ideal droplet deposition position") X0, and the error ΔX.

Figure 1A:
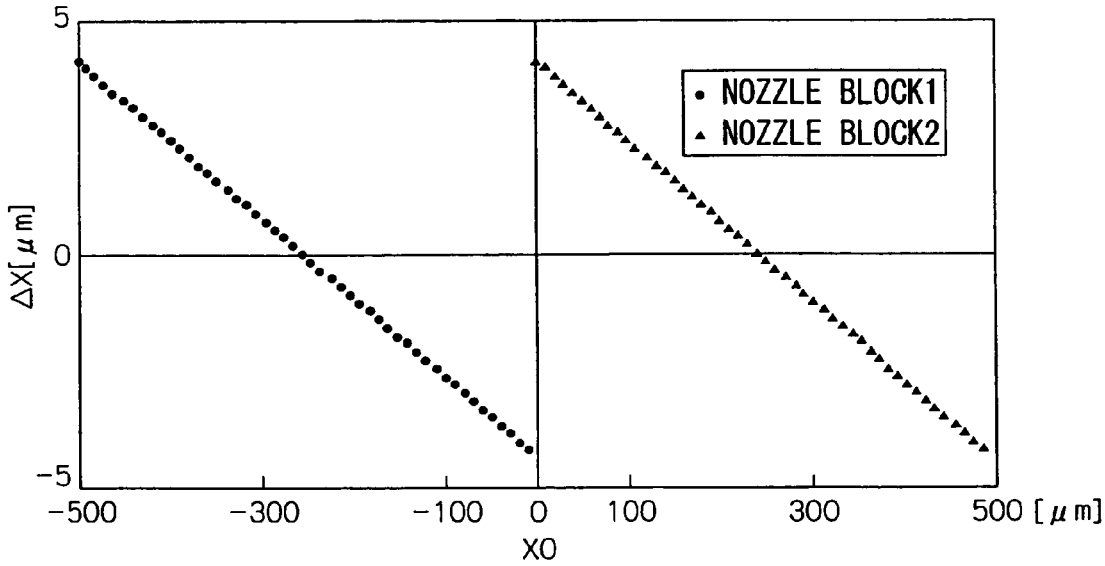
FIGS. 1A and 1B are diagrams showing an embodiment of the amount of droplet deposition position displacement ΔX from the ideal position, for each nozzle block in a matrix head.
Figure 1B:
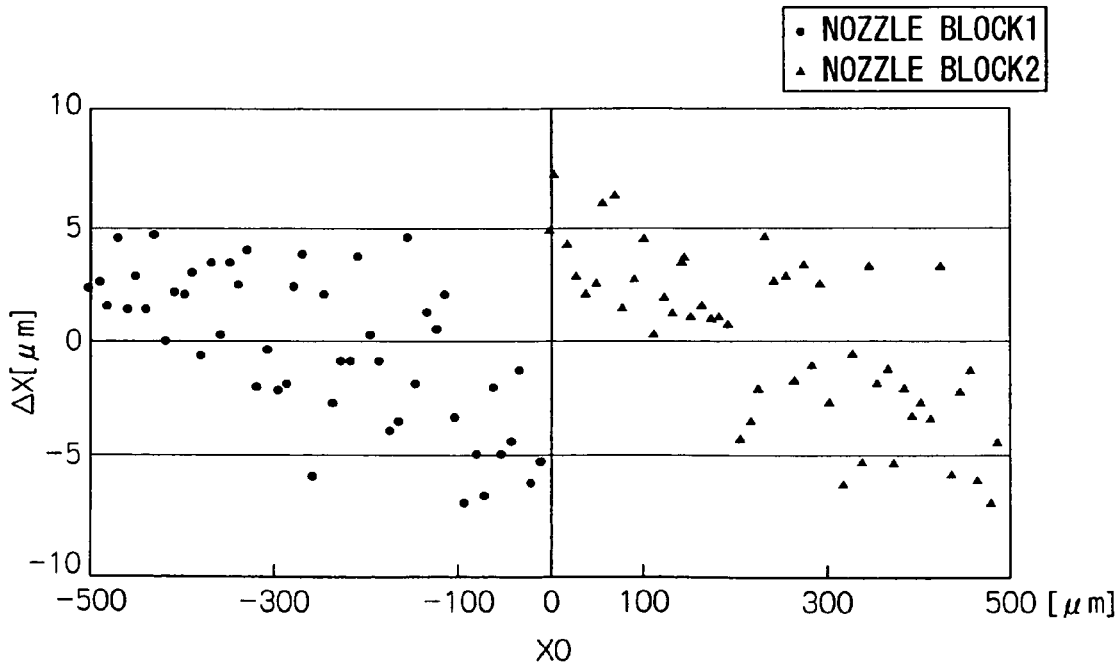

FIGS. 1A and 1B show a calculation for ΔX in a case where the two nozzle blocks (each of the nozzle blocks having 49 nozzles) are inclined at an angle of 0.02 degrees in a matrix head. If there is no displacement in the ejection direction of the nozzles themselves, then ΔX traces a straight line having a uniform gradient, for each nozzle block (as in FIG. 1A). However, if in practice there is displacement of the ejection direction of the nozzles themselves, then δXD values are different for each nozzle and hence the ΔX values become as shown in FIG. 1B. It is difficult to calculate an accurate amount of adjustment for the head from the results of ΔX shown in FIG. 1B.

Figure 2A:
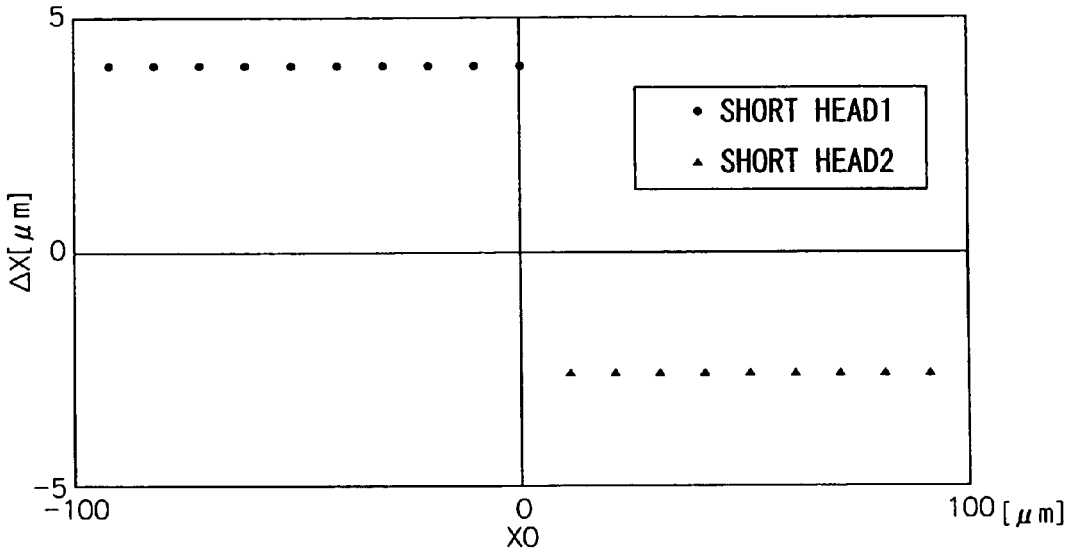
FIGS. 2A and 2B are diagrams showing an embodiment of the amount of droplet deposition position displacement ΔX from the ideal position in a head composition in which short heads are joined together.
Figure 2B:
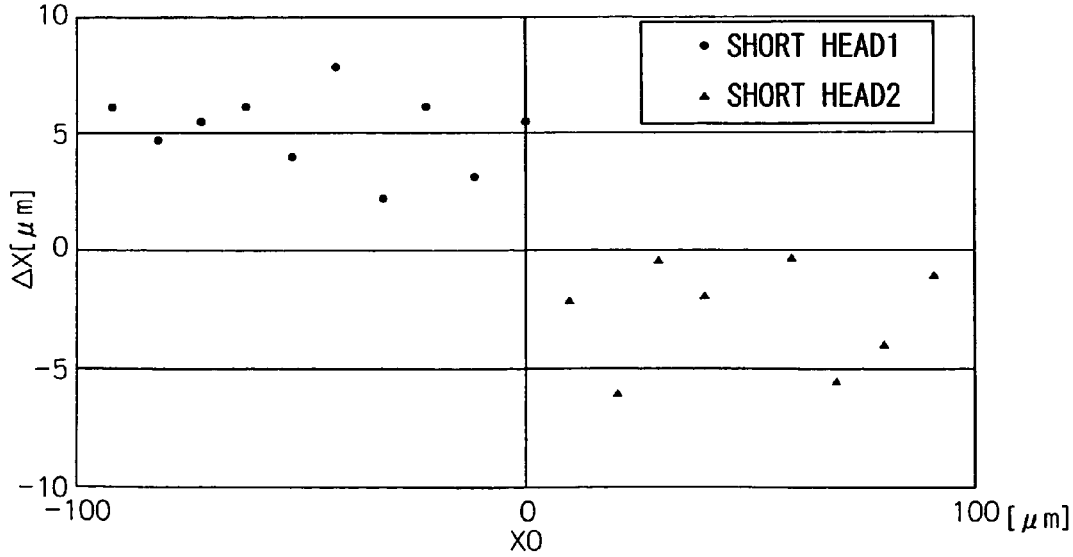

Furthermore, FIGS. 2A and 2B show calculations of ΔX in a line head formed by joining together a plurality of short heads (in this case, short head 1 and short head 2), in which short head 1 is installed with a displacement of +4 μm in the main scanning direction from its ideal position, and short head 2 is installed with a displacement of −2.5 μm in the main scanning direction.

If there is no displacement in the ejection direction of the nozzles themselves, then ΔX is a uniform value, for each short head (as in FIG. 2A). However, if in practice there is displacement of the ejection direction of the nozzles themselves, then the δXD values are different for each nozzle, and hence ΔX values become as shown in FIG. 2B. In this case also, it is difficult to calculate the amount of adjustment of the head, accurately.

Therefore, in the present embodiment, processing is carried out for separating δXD and δXH from the error ΔX. Below, an embodiment of a method for calculating δXD and δXH is described.

Calculation Method 1

Droplets are ejected to form a (second) test pattern, after adjusting the distance from the nozzle to the recording medium to being k times (where k>0 and k≠1) longer than that in the case of the droplet ejection of the (first) test pattern. The positions X' of the dots ejected in the second test pattern are measured by an image reading apparatus, such as a scanner. The positions X' of the dots are expressed by the following formula.

$$X'=X0+\delta XH+k\times\delta XD \quad \text{(Formula 2)}$$

In other words, there is no change in the error δXH caused by incorrect installation of the head, but the error caused by displacement of the ejection direction is multiplied by k.

The values of δXH and δXD are determined according to the above Formulas 1 and 2, and the amount of shift for the angle of rotation of the head or the joint sections (in other words, the amount of adjustment of the head) is calculated on the basis of the δXH value thus calculated.

The position of the head is adjusted in accordance with the value of the adjustment value thus calculated. In the case of a matrix head, for example, a rotational movement mechanism can be used for the device for adjusting the position of the head. Furthermore, in the case of a composition in which short heads are joined together, a head-to-head distance movement mechanism can be used for altering the distance between the short heads.

The specific structure of the movement mechanisms is not limited in particular, and it is also possible to apply commonly known compositions which achieve the desired movement function. In the case of a line head constituted by joining together short heads in a matrix arrangement, desirably, both a rotational movement mechanism and a movement mechanism for altering the distance between the short heads are provided. In this case, a desirable adjustment sequence is one in which, firstly, the position between the short heads (shift amount) is adjusted, and then the rotational position is adjusted.

Calculation Method 2

Since δXD is caused by displacement in the ejection angle, the ejection state is captured by means of a high-speed camera, or the like, and the amount of displacement of the ejection angle is calculated by analyzing this captured image. The value of δXD is calculated on the basis of the value thus calculated (the amount of displacement of the ejection angle) and the distance from the nozzle to the recording medium. Hence it is possible to calculate δXH on the basis of the value of δXD, and Formula 1 stated above.

Next, an embodiment of a method of correcting the error δXD caused by displacement of the ejection direction is described below.

The intrinsic nozzle error δXD is explained below. In particular, if the direction of flight is displaced in the main scanning direction, then banding occurs in parallel with the sub-scanning direction, and this is a cause of marked deterioration in the image quality. Below, a method for preventing this banding by varying the droplet ejection rate with respect to each nozzle is described. The following description indicates an embodiment.

Figure 3A:
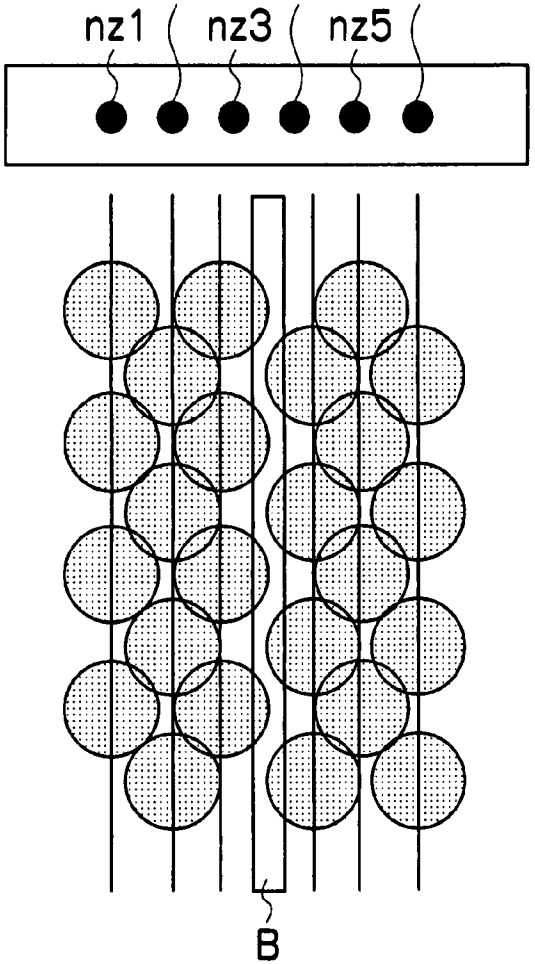
FIGS. 3A and 3B are schematic drawings showing an embodiment of correction of the droplet ejection arrangement which reduces the visibility of banding.
Figure 3B:
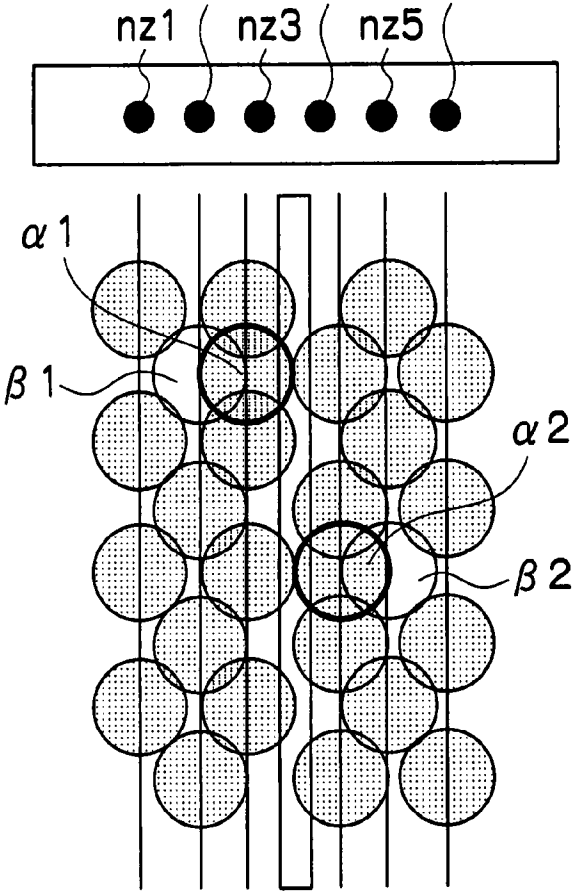

FIGS. 3A and 3B are schematic drawings of droplet ejection arrangements in the case of a nozzle pitch (nozzle density) of 1200 npi (nozzles per inch). The nozzles may be arranged in a matrix structure, but in the present embodiment, they are described schematically as a single row arrangement, as shown in FIGS. 3A and 3B.

In FIG. 3A, nozzles nz3 and nz4 have ejection direction displacement, and respectively have droplet deposition position errors (landing position displacement) of −5 μm and +5 μm in the main scanning direction on the recording surface (where, the rightward direction is the positive direction, in the diagrams). Therefore, a white band appears between the nozzles nz3 and nz4 (the region indicated by B in FIG. 3A).

FIG. 3B shows a case where this white hand has been corrected. More specifically, in order to reduce the visibility of the white banding occurring between the nozzles nz3 and nz4 (the region indicated by reference numeral B in FIG. 3A), in FIG. 3B, the number of dots formed by the nozzles nz3 and nz4 are increased by one each, while at the same time, the number of dots formed by the nozzles nz2 and nz5, which are adjacent to the nozzles nz3 and nz4, are reduced by one each. In FIG. 3B, the dots indicated by reference numerals α1 and α2 are additional dots, and the blank dot circles indicated by reference numerals β1 and β2 are removed dots (which are not recorded).

By correcting the droplet ejection arrangement in this way, it is possible to reduce the visibility of white banding while the average density value is maintained.

In implementing embodiments of the present invention, the method of correcting the droplet ejection arrangement on the basis of the information relating to the droplet deposition position error is not limited in particular to those described above, and it is possible to use a variety of different methods including commonly known techniques.

Composition of Inkjet Recording Apparatus

Next, the inkjet recording apparatus which is a concrete embodiment of the image forming apparatus relating to the present invention is described below.

Figure 4:
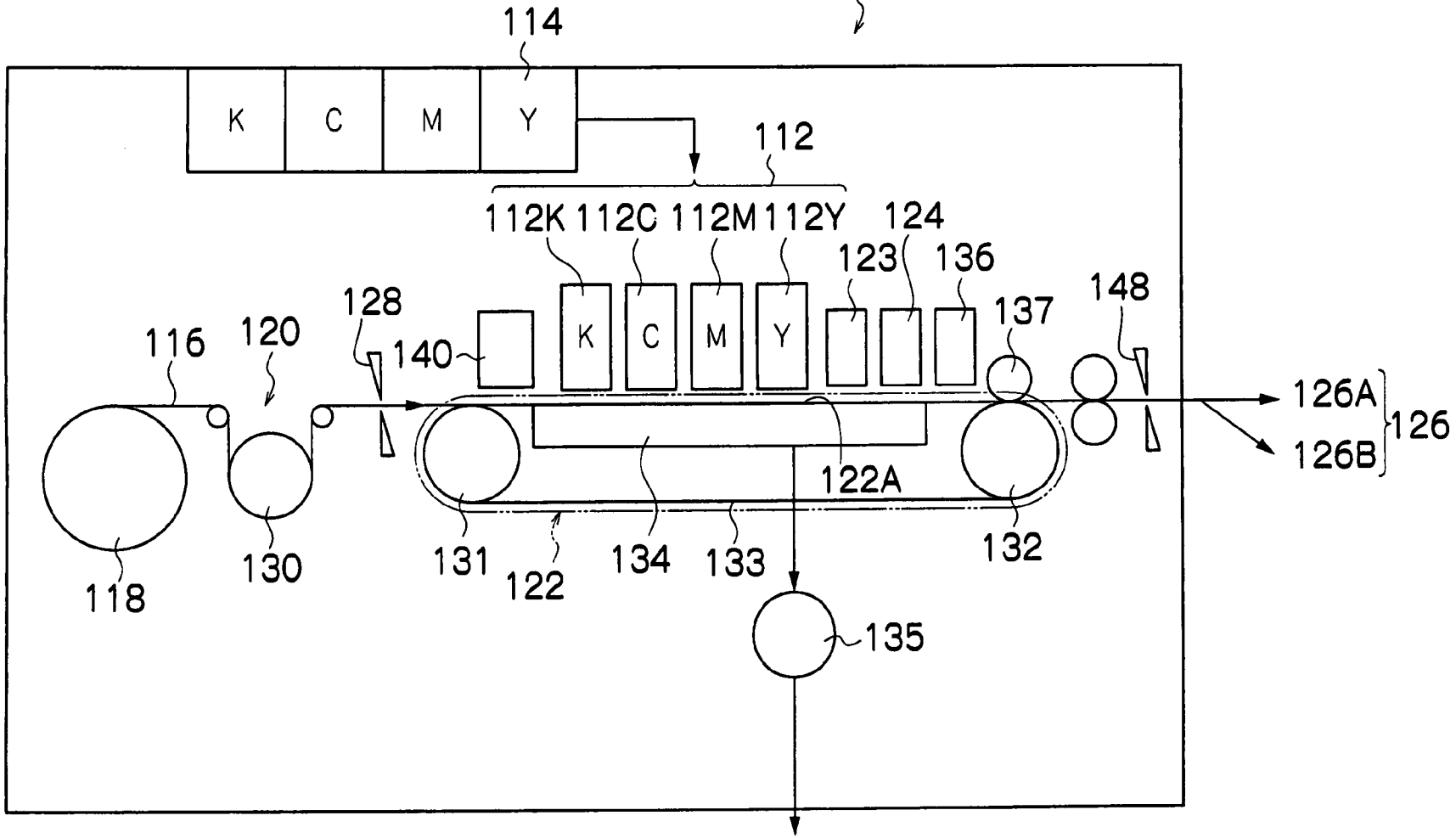
FIG. 4 is a general schematic drawing of an inkjet recording apparatus according to a first embodiment of an image forming apparatus relating to the present invention.

FIG. 4 is a general schematic drawing of an inkjet recording apparatus which forms a first embodiment of an image forming apparatus relating to the present invention. As shown in FIG. 4, the inkjet recording apparatus 110 comprises: a printing unit 112 having a plurality of inkjet recording heads (hereafter, called "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the print heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink-droplet ejection face) of the printing unit 112, for conveying the recording paper 116 while keeping the recording paper 116 flat; a distance measurement unit 123 for measuring the distance to the recording surface; a print determination unit 124 for reading the printed result produced by the printing unit 112; and a paper output unit 126 for outputting image-printed recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 4, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (media) can be used, it is preferable that an information recording medium such as a bar code and a wireless tag containing information about the type of media is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 4, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 (corresponding to the conveyance belt) is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. Furthermore, in the case of a composition in which a test pattern for measuring the amount of droplet deposition position displacement is recorded directly onto the belt 133, a region for printing the test pattern is provided on the belt 133.

A suction chamber 134 is disposed in a position facing the sensor surface of the print determination unit 124 and the nozzle surface of the printing unit 112 on the interior side of the belt 133, which is set around the rollers 131 and 132, as shown in FIG. 4. The suction chamber 134 provides suction with a fan 135 to generate a negative pressure, and the recording paper 116 is held on the belt 133 by suction. It is also possible to use an electrostatic attraction method, instead of a suction-based attraction method.

The belt 133 is driven in the clockwise direction in FIG. 4 by the motive force of a motor 188 (shown in FIG. 9) being transmitted to at least one of the rollers 131 and 132, which the belt 133 is set around, and the recording paper 116 held on the belt 133 is conveyed from left to right in FIG. 4.

If the test pattern for measuring the amount of droplet deposition position displacement is printed onto a prescribed region on the belt 133 (teat pattern printing region), or if a borderless print, or the like, is printed, then ink is also deposited on the belt 133, and therefore a belt cleaning unit 136 is provided at a prescribed position outside the print region, as a cleaning device for the belt 133.

In the embodiment shown in FIG. 4, a belt cleaning unit 136 is provided after the print determination unit 124 and before the conveyance roller 137. Although the details of the configuration of the belt cleaning unit 136 are not shown, embodiments thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different from that of the belt 33, in order to improve the cleaning effect.

The inkjet recording apparatus 110 can comprise a roller nip conveyance mechanism, in which the recording paper 116 is pinched and conveyed with nip rollers, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 (before the printing unit 112) in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 5:
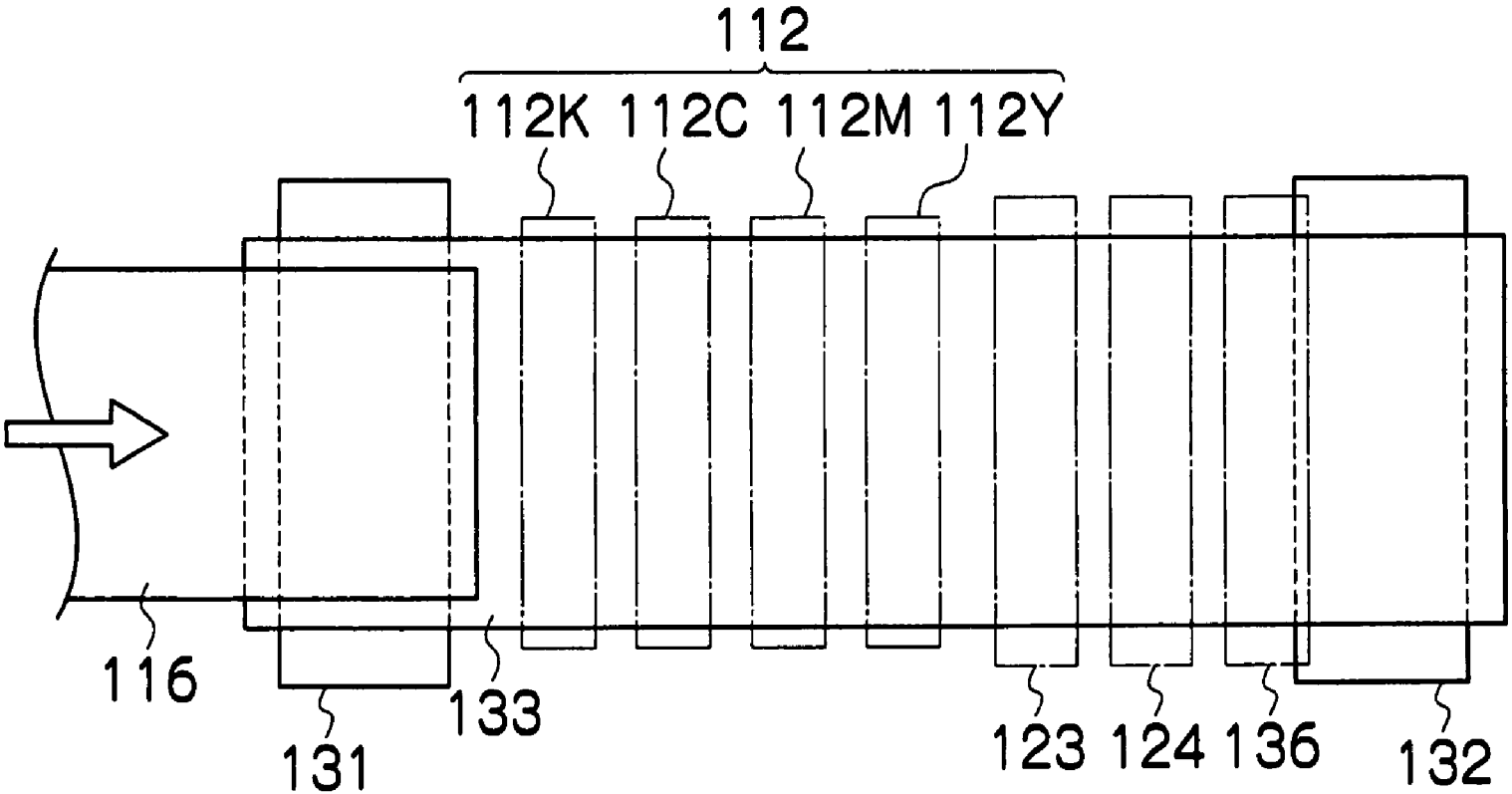
FIG. 5 is a principal plan diagram of the peripheral area of a print unit in the inkjet recording apparatus illustrated in FIG. 4.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 5).

The print heads 112K, 112C, 112M and 112Y are arranged in color order (black (K), cyan (C), magenta (M), yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the four standard colors of K, C, M and Y is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The distance measurement unit 123 shown in FIG. 4 is a device which measures the distance to the recording surface by means of a pulse laser, and the distance information between each of the nozzle surfaces of the heads 112K, 112C, 112M and 112Y and the recording surface is acquired on the basis of these measurement results. For the device which identifies the distance between each ejection surface and the recording surface (the distance identification device), it is possible to use a measurement device which actually measures the distance, and it is also possible to use a device which acquires information on the thickness of the recording medium used. As a device which acquires information on the thickness of the recording medium, apart from a device which actually measures the thickness, it is also possible to adopt a mode in which the thickness information is input by means of a user interface, a mode where the thickness information is read in from an information recording unit attached to the container (magazine, cassette, or the like) which accommodates the recording medium, or the like.

As a device which varies the distance between each nozzle surface and the recording surface, it is possible to adopt a mode where the presence/absence of a recording medium (recording paper 116) is used, a mode where the recording media (recording papers 116) of different thicknesses is used, a mode where a head movement device which moves the heads 112K, 112C, 112M and 112Y toward and away from the medium supporting surface 122A of the belt conveyance unit 122 (in the case of FIG. 4, a movement device which raises and lowers the heads 112K, 112C, 112M and 112Y) is provided, or a mode where a belt conveyance unit movement device which moves the belt conveyance unit 122 in such a manner that the medium supporting surface 122A of the belt conveyance direction moves towards and away from the nozzle surfaces of the heads 112K, 112C, 112M and 112Y (in the case of FIG. 4, a movement device which raises and lowers the belt conveyance unit 122) is provided.

The print determination unit 124 includes an image sensor (line sensor or area sensor) for capturing an image of the droplet deposition result by the print unit 112, and functions as a device to check the ejection characteristics of the nozzles, such as blockages, droplet deposition position error, and the like, on the basis of an image which are formed by the ejected droplets and are read in by the image sensor. A test pattern or the target image printed by the print heads 112K, 112C, 112M, and 112Y of the respective colors is read in by the print determination unit 124, and the ejection state of each head is determined. The ejection state determination is carried out on the basis of the presence or absence of the ejection, measurement of the dot size, and measurement of the dot landing position (droplet deposition position).

The printed matter on which an image has been recorded by the print unit 112 is output from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 4, the paper output unit 126A for the target prints is provided with a sorter for collecting prints according to print orders.

Structure of the Head

Next, the structure of a head is described below. The heads 112K, 112C, 112M and 112Y of the respective ink colors have the same structure, and a reference numeral 150 is hereinafter designated to any of the heads.

Figure 6A:
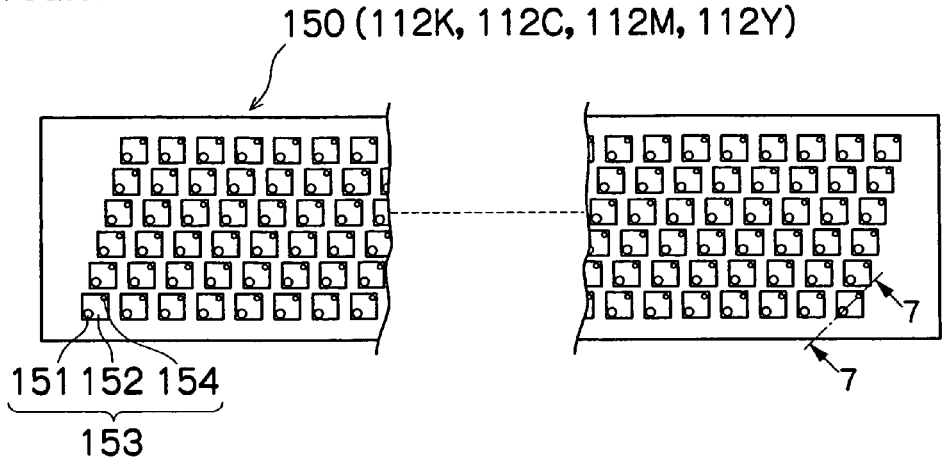
FIG. 6A is a plan view perspective diagram showing an embodiment of the composition of a print head.
Figure 6B:
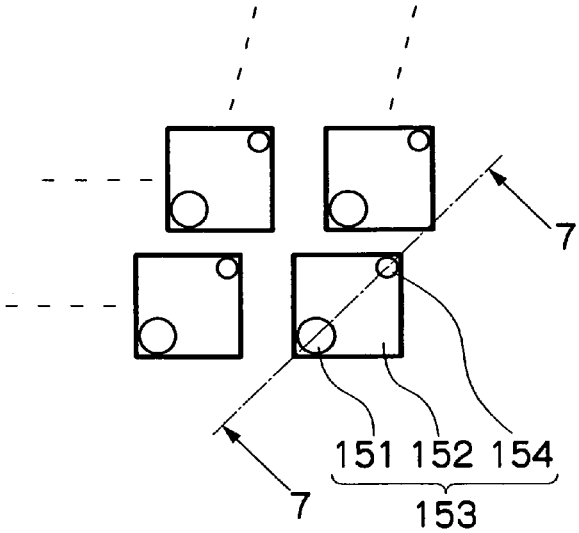
FIG. 6B is a principal enlarged view of FIG. 6A.
Figure 6C:
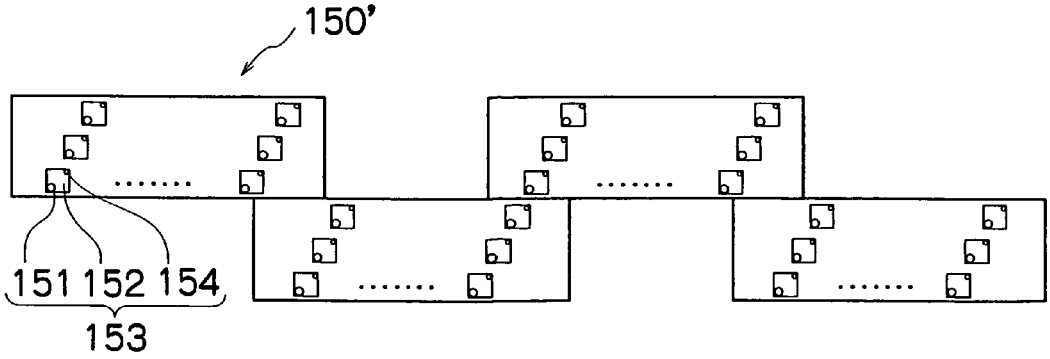
FIG. 6C is a plan view perspective diagram showing another embodiment of the structure of a full line head.
Figure 7:
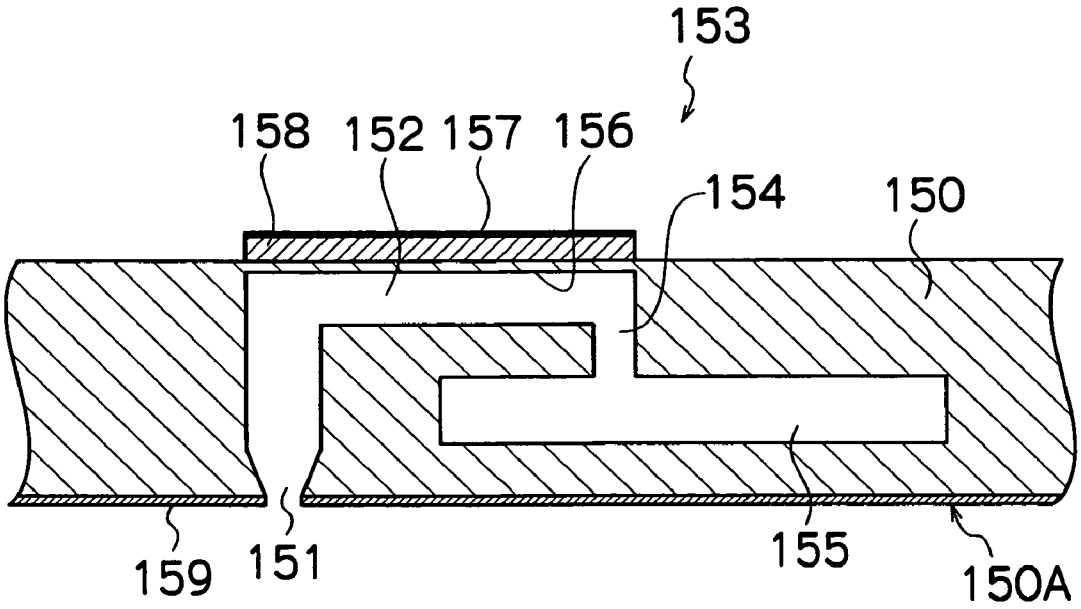
FIG. 7 is a cross-sectional view along line 7-7 in FIG. 6A.

FIG. 6A is a perspective plan view showing an embodiment of the configuration of the head 150, FIG. 6B is an enlarged view of a portion thereof, FIG. 6C is a perspective plan view showing another embodiment of the configuration of the head 150, and FIG. 7 is a cross-sectional view taken along the line 7-7 in FIG. 6A, showing the three-dimensional structure of a droplet ejection element for one channel (an ink chamber unit for one nozzle 151).

The nozzle pitch in the head 150 is required to be minimized in order to maximize the density of the dots printed on the surface of the recording paper 116. As shown in FIGS. 6A and 6B, the head 150 according to the present embodiment has a structure in which a plurality of ink chamber units (droplet ejection elements) 153, each comprising a nozzle 151: forming an ink ejection port, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 116 in a direction substantially perpendicular to the conveyance direction of the recording paper 116 is not limited to the embodiment described above. For example, instead of the configuration in FIG. 6A, as shown in FIG. 6C, a line head having nozzle rows of a length corresponding to the entire width of the recording paper 116 can be formed by arranging and combining, in a staggered matrix, short head blocks 150' having a plurality of nozzles 151 arrayed in a two-dimensional fashion.

As shown in FIGS. 6A and 6B, the planar shape of the pressure chamber 152 provided corresponding to each nozzle 151 is substantially a square shape, and an outlet port to the nozzle 151 is provided at one of the ends of the diagonal line of the planar shape, while an inlet port (supply port) 154 for supplying ink is provided at the other end thereof. The shape of the pressure chamber 152 is not limited to that of the present embodiment and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 7, each pressure chamber 152 is connected to a common channel 155 through the supply port 154. The common channel 155 is connected to an ink tank 60 (not shown), which is a base tank that supplies ink, and the ink supplied from the ink tank is distributed and delivered through the common flow channel 155 to the pressure chambers 152.

An actuator 158 provided with an individual electrode 157 is bonded to a pressure plate (a diaphragm that also serves as a common electrode) 156 which forms the surface of one portion (in FIG. 7, the ceiling) of the pressure chambers 152. When a drive voltage is applied to the individual electrode 157 and the common electrode, the actuator 158 deforms, thereby changing the volume of the pressure chamber 152.

This causes a pressure change which results in ink being ejected from the nozzle 151. For the actuator 158, it is possible to adopt a piezoelectric element using a piezoelectric body, such as lead zirconate titanate, barium titanate, or the like. When the displacement of the actuator 158 returns to its original position after ejecting ink, the pressure chamber 152 is replenished with new ink from the common flow channel 155, via the supply port 154.

Furthermore, a lyophobic layer 159 is provided on the nozzle surface 150A of the head 150, from the viewpoint of improving the ejection stability and the cleaning properties of the ejection surface (nozzle surface 150A). There are no particular restrictions on the method for imparting lyophobic properties to the nozzle surface 150A (the lyophobic process method), and possible methods include, for example, a method involving coating (applying) of a fluorine-based lyophobic material, and a method involving the formation of a thin layer on the nozzle surface by vapor deposition of a lyophobic material, such as particles of a fluorine-based high polymer (PTFE), in a vacuum.

By controlling the driving of the actuators 158 corresponding to the nozzles 151 in accordance with the droplet ejection arrangement data generated from the input image, it is possible to eject ink droplets from the nozzles 151. As shown in FIG. 4, by controlling the ink ejection timing with respect to the nozzles 151 in accordance with the speed of conveyance of the print medium 116 while the recording paper 116 forming the recording medium is conveyed in the sub-scanning direction at a uniform speed, it is possible to record a desired image on the print medium 116.

Figure 8:
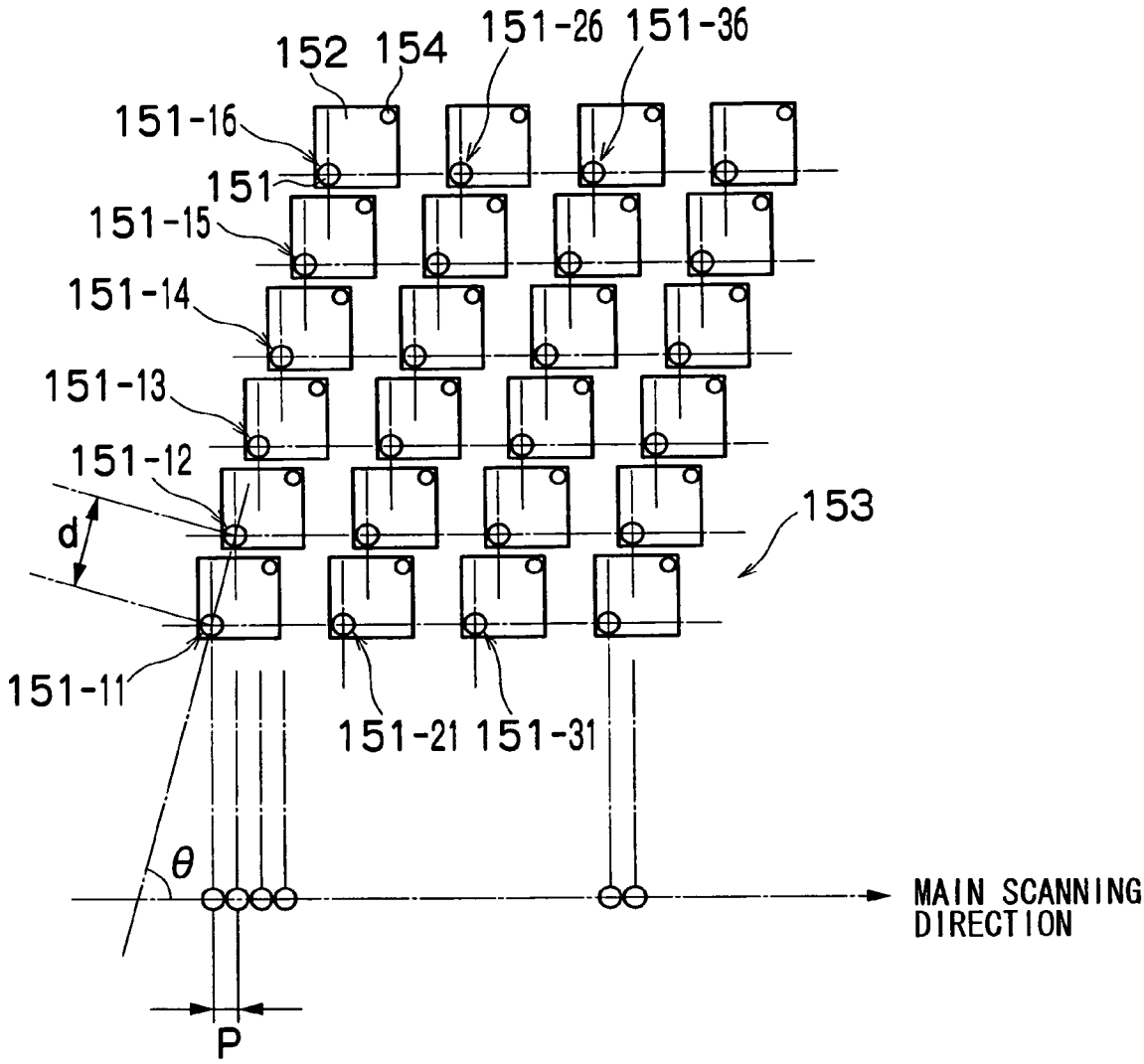
FIG. 8 is an enlarged view showing a nozzle arrangement in the print head illustrated in FIG. 6A.

As shown in FIG. 8, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 153 are arranged at a uniform pitch d in line with a direction forming an angle of θ with respect to the main scanning direction, the pitch P of the nozzles projected so as to align in the main scanning direction is $d \times \cos\theta$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 8 are driven, the main scanning according to the above-described (3) is preferred. More specifically, the nozzles 151-11, 151-12, 151-13, 151-14, 151-15 and 151-16 are treated as a block (additionally; the nozzles 151-21, . . . , 151-26 are treated as another block; the nozzles 151-31, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 116 is called the sub-scanning direction and the direction perpendicular to same is called the main scanning direction.

In implementing embodiments of the present invention, the arrangement of the nozzles is not limited to that of the embodiment illustrated. Moreover, a method is employed in the present embodiment where an ink droplet is ejected by means of the deformation of the actuator 158, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 9:
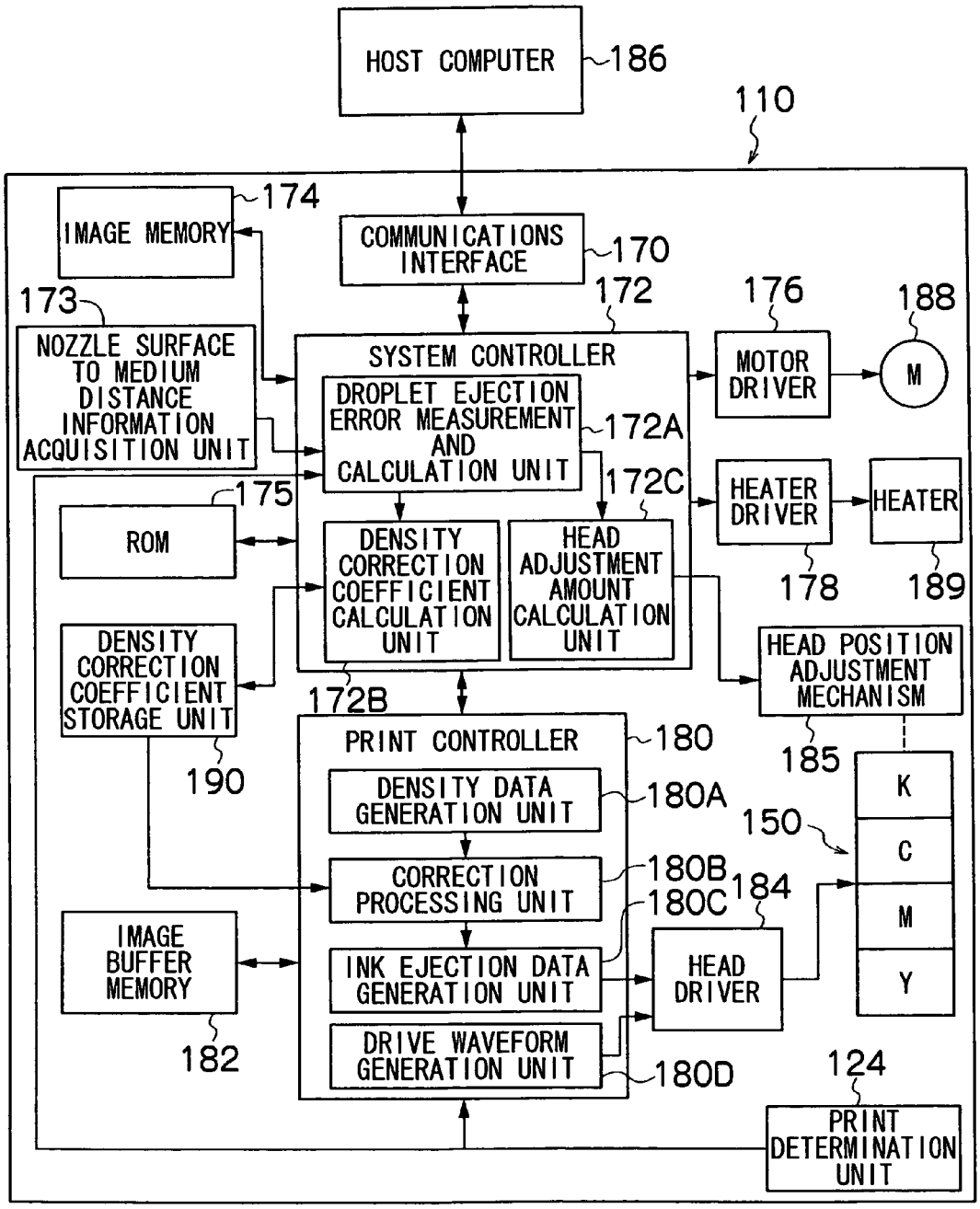
FIG. 9 is a principal block diagram showing the system configuration of the inkjet recording apparatus according to a first embodiment.

FIG. 9 is a block diagram showing the system composition of the inkjet recording apparatus 110. As shown in FIG. 9, the inkjet recording apparatus 110 comprises a communications interface 170, a system controller 172, a nozzle surface to medium distance information acquisition unit 173, an image memory 174, a ROM 175, a motor driver 176, a heater driver 178, a print controller 180, an image buffer memory 182, a head driver 184, a head position adjustment mechanism 185, and the like.

The communications interface 170 is an interface unit (image input unit) which functions as an image input device for receiving image data transmitted by a host computer 186. For the communications interface 170, a serial interface, such as USB (Universal Serial Bus), IEEE 1394, an Ethernet (registered trademark), or a wireless network, or the like, or a parallel interface, such as a Centronics interface, or the like, can be used. It is also possible to install a buffer memory (not illustrated) for achieving high-speed communications.

The image data sent from the host computer 186 is received by the inkjet recording apparatus 110 through the communication interface 170, and is temporarily stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and the ROM 175, and it also generates control signals for controlling the motor 188 and heater 189 of the conveyance system.

Furthermore, the system controller 172 comprises: a droplet ejection error measurement and calculation unit 172A which carries out calculation processing for generating droplet deposition position error data on the basis of distance information obtained from a nozzle surface to medium distance information acquisition unit 173, and read data for a test pattern read in from the print determination unit 124; a density correction coefficient calculation unit 172B which calculates a density correction coefficient from the information (δXD) relating to the error component caused by ejection direction displacement that is intrinsic to a nozzle, of the measured position error; and a head adjustment amount calculation unit 172C which calculates the amount of adjustment of the head from the information (δXH) relating to the error component caused by displacement in the installation of the head, of the measured position error. The processing functions of the droplet ejection error measurement and calculation unit 172A, the density correction coefficient calculation unit 172B and the head adjustment amount calculation unit 172C can be achieved by means of ASIC, software or a combination of same.

In the density correction coefficient calculation unit 172B, a density correction coefficient is calculated for each nozzle, on the basis of each value of δXD. The density correction coefficient data determined by the density correction coefficient calculation unit 172B is stored in a density correction coefficient storage unit 190.

Furthermore, the head position adjustment mechanism 185 is controlled, thereby adjusting the head installation position, in accordance with the value of the head adjustment amount determined by the head adjustment amount calculation unit 172C. The head position adjustment mechanism 185 may have a composition in which the mechanism is controlled automatically by means of an electric drive device, such as a motor; and it may also have a composition in which the value of the head adjustment amount determined by the head adjustment amount calculation unit 172C is shown on a display monitor, or the like (not illustrated), and the head installation position is then adjusted according to this display by means of an operator manually controlling the head position adjustment mechanism 185.

For the method of determining the density correction coefficient on the basis of the value of δXD in the density correction coefficient calculation unit 172B, and the method of determining the head adjustment amount on the basis of the value of δXD in the head adjustment amount calculation unit 172C, it is possible to use a calculation formula (e.g., a function indicating a correlation, or the like) based on a prescribed algorithm, and it is also possible to use a look-up table, or the like.

The nozzle surface to medium distance information acquisition unit 173 may include a mode, such as a distance measurement unit 123 as shown in FIG. 4, or a user interface whereby a user inputs thickness information relating to the recording medium (recording paper 116).

The ROM 175 stores programs to be executed by the CPU of the system controller 172 and various types of data required for control purposes (for example, data on test patterns for measuring droplet deposition position errors, formulas for calculating the amount of deposition position errors, and the values of the look-up tables), and the like. The ROM 175 may be a non-rewriteable storage device; however, if the information relating to the droplet deposition positions is to be updated, then desirably, a rewriteable storage device such as an EEPROM is used. Furthermore, by using a storage region of the ROM 175, a composition is also possible in which the ROM 175 is also used as the density correction coefficient storage unit 190.

The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit or the like in accordance with commands from the system controller 172.

The print controller 180 is a control unit which functions as a signal processing device for performing various treatment processes, corrections, and the like, in accordance with the control implemented by the system controller 172, in order to generate a signal for controlling droplet ejection on the basis of the image data (multiple-value input image data) in the image memory 174, and the print controller 180 also functions as an ejection control device which controls the ejection driving of the head 150 by supplying the ink ejection data thus generated to the head driver 184.

In other words, the print controller 180 comprises a density data generation unit 180A, a correction processing unit 180B, an ink ejection data generation unit 180C and a drive waveform generation unit 180D. These functional blocks (180A-180D) can be achieved by means of ASIC, software, or a suitable combination of same.

The density data generation unit 180A is a signal processing device which generates density data for each ink color, from the input image data, and it carries out density conversion processing (including UCR processing and color conversion processing) and, where necessary, it also performs pixel number conversion processing.

The correction processing unit 180B is a processing device which calculates density corrections by using the density correction coefficients stored in the density correction coefficient storage unit 190.

The ink ejection data generation unit 180C is a signal processing device including a halftoning processing device which converts the corrected density data generated by the correction processing unit 180B into binary (or multiple-value) droplet ejection arrangement data (dot data).

The image processing sequence performed in the print controller 180 is described below. There are no particular restrictions on the data format of the input image, and 24-bit RGB data can be input, for example. Density conversion processing based on a look-up table is carried out on this input image, thereby converting it into density data D(i, j) corresponding to the ink colors of the printers. Here, "(i, j)" indicates the position of a pixel, and hence the density data is assigned to each pixel.

In the present embodiment, it is supposed that the image resolution of the input image 20 matches (corresponds with) the image resolution (nozzle resolution) of the printer. If these two resolutions are not matching, then pixel number conversion processing is carried out on the input image, in accordance with the resolution of the printer.

The density conversion processing uses a general process, which includes under color removal (UCR) processing, or light ink distribution processing in the case of a system which uses light inks (weak inks (light shade inks) of the same color).

For example, in the case of a three-ink composition, comprising C (cyan), M (magenta) and Y (yellow), the image is converted into CMY density data D(i, j). Alternatively, in the case of a system which also uses other inks, such as K (black), LC (light cyan), and LM (light magenta), in addition to the aforementioned three inks, then the image is converted into density data D(i, j) which includes these ink colors.

The density data D(i, j) generation processing described above is carried out by the density data generation unit 180A shown in FIG. 9.

The correction processing unit 180B carries out correctional processing on the density data D(i, j) which has been subjected to the aforementioned density conversion processing. Here, a calculation is performed in order to multiply the density correction coefficient (droplet ejection rate correction coefficient) di corresponding to the related nozzle, by the density data D(i, j).

More specifically, the pixel position (i,j) on the image is identified by the position i of the nozzle nzi (main scanning direction position) and a sub-scanning direction position j, and density data D(i, j) is assigned to each of the pixels. If the correction processing is carried out for the nozzle which ejects a droplet to form a dot of the pixel column adjacent (near) to the location where a white stripe (banding) indicated by reference numeral B in FIGS. 3A and 3B, then the density data D'(i, j) after the correction can be calculated by the following equation:

$$D'(i,j)=D(i,j)+di\times D(i,j).$$

In this way, the corrected density data D'(i, j) is obtained.

The processing for generating corrected data D'(i, j) according to the above-mentioned calculation formula is carried out by the correction processing unit 180B in FIG. 9.

After that, by applying a half-toning process to the aforementioned corrected density data D'(i, j), the data is converted into a dot on/off signal (binary value data), or alternatively, if variation of the dot size is included, then it is converted into a multiple-value data signal including the size type (selection of dot size). There are no particular restrictions on the half-toning method used, and a commonly known binarization technique (multiple-value conversion technique), such as error diffusion method or dithering, may be used.

Ink ejection (droplet deposition) data for each nozzle is generated on the basis of the binary (multiple-value) signal thus obtained. The processing for generating ink ejection data including the aforementioned halftoning process is carried out by the ink ejection data generation unit 180C in FIG. 9.

The ink ejection data generated by the ink ejection data generation unit 180C is supplied to the head driver 184, and accordingly the ink ejection operation of the head 150 is controlled.

The drive waveform generation unit 180D is a device for generating drive signal waveform in order to drive the actuators 158 (see FIG. 7) corresponding to the respective nozzles 151 of the head 150. The signal (drive waveform) generated by the drive waveform generation unit 180D is supplied to the head driver 184. The signal output from the drive signal generation unit 180D may be digital waveform data, or it may be an analog voltage signal.

As shown in FIG. 9, the image buffer memory 182 is provided with the print controller 180, and image data, parameters, and other data are temporarily stored in the image buffer memory 182 when image data is processed in the print controller 180. FIG. 9 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed is input from an external source via the communications interface 170, and is accumulated in the image memory 174. At this stage, multiple-value RGB image data is stored in the image memory 174, for example.

In the inkjet recording apparatus 110, an image which appears to have a continuous tonal gradation to the human eye is formed by changing the droplet deposition density or the dot size of fine dots created by ink (coloring material). Hence, it is necessary to convert the input digital image into a dot pattern which reproduces the tonal gradations of the image (namely, the light and shade toning of the image) as faithfully as possible. Therefore, original image data (RGB data) stored in the image memory 174 is sent to the print controller 180, via the system controller 172, and is converted to the dot data for each ink color by passing through the density data generation unit 180A, the correction processing unit 180B, and the ink ejection data generation unit 180C of the print controller 180.

In other words, the print controller 180 performs processing for converting the input RGB image data into dot data for the four colors of K, C, M and Y. The dot data generated by the print controller 180 in this way is stored in the image buffer memory 182. This dot data, which is generated for each color, is converted into CMYK droplet ejection arrangement data for ejecting ink from the nozzles of the head 150, thereby fixing the ink ejection data for printing.

The head driver 184 outputs drive signals for driving the actuators 158 corresponding to the nozzles 151 of the head 150 in accordance with the print contents, on the basis of the ink ejection data and the drive waveform signals supplied by the print controller 180. A feedback control system for maintaining constant drive conditions in the head may be included in the head driver 184.

By supplying the drive signals output by the head driver 184 to the head 150 in this way, ink is ejected from the corresponding nozzles 151. By controlling ink ejection from the print head 150 in synchronization with the conveyance speed of the recording paper 116, an image is formed on the recording paper 116.

As described above, the ejection volume and the ejection timing of the ink droplets from the respective nozzles are controlled via the head driver 184, on the basis of the ink ejection data and the drive signal waveform generated by implementing required signal processing in the print controller 180. By this means, desired dot size and dot positions can be achieved. Furthermore, in the present embodiment, at a stage prior to the halftoning process, the image data is corrected to take account of droplet deposition position error, and therefore banding caused by a droplet deposition position error can be corrected accurately.

As shown in FIG. 4, the print determination unit 124 is a block including an image sensor. The print determination unit 124 reads in the image printed onto the recording medium 116, performs various signal processing operations, and the like, determines the print situation (presence/absence of ejection, variation in droplet deposition positions, optical density, and the like), and supplies these determination results to the print controller 180 and the system controller 172.

The print controller 180 implements various corrections with respect to the head 150, on the basis of the information obtained from the print determination unit 124, according to requirements, and it implements control for carrying out cleaning operations (nozzle restoring operations), such as preliminary ejection, suctioning, or wiping, as and when necessary.

In the case of the present embodiment, the combination of the system controller 172 and the print controller 180 corresponds to the "droplet ejection control device", and the combination of the print determination unit 124 and the droplet ejection error measurement and calculation unit 172A corresponds to the "droplet deposition position error measurement device". Furthermore, the droplet ejection error measurement and calculation device 172A of the present embodiment includes the functions of the "error cause separation device". Furthermore, the head adjustment amount calculation unit 172C corresponds to the "adjustment amount calculation device", and the head position adjustment mechanism 185 corresponds to the "position adjustment device".

Figure 10:
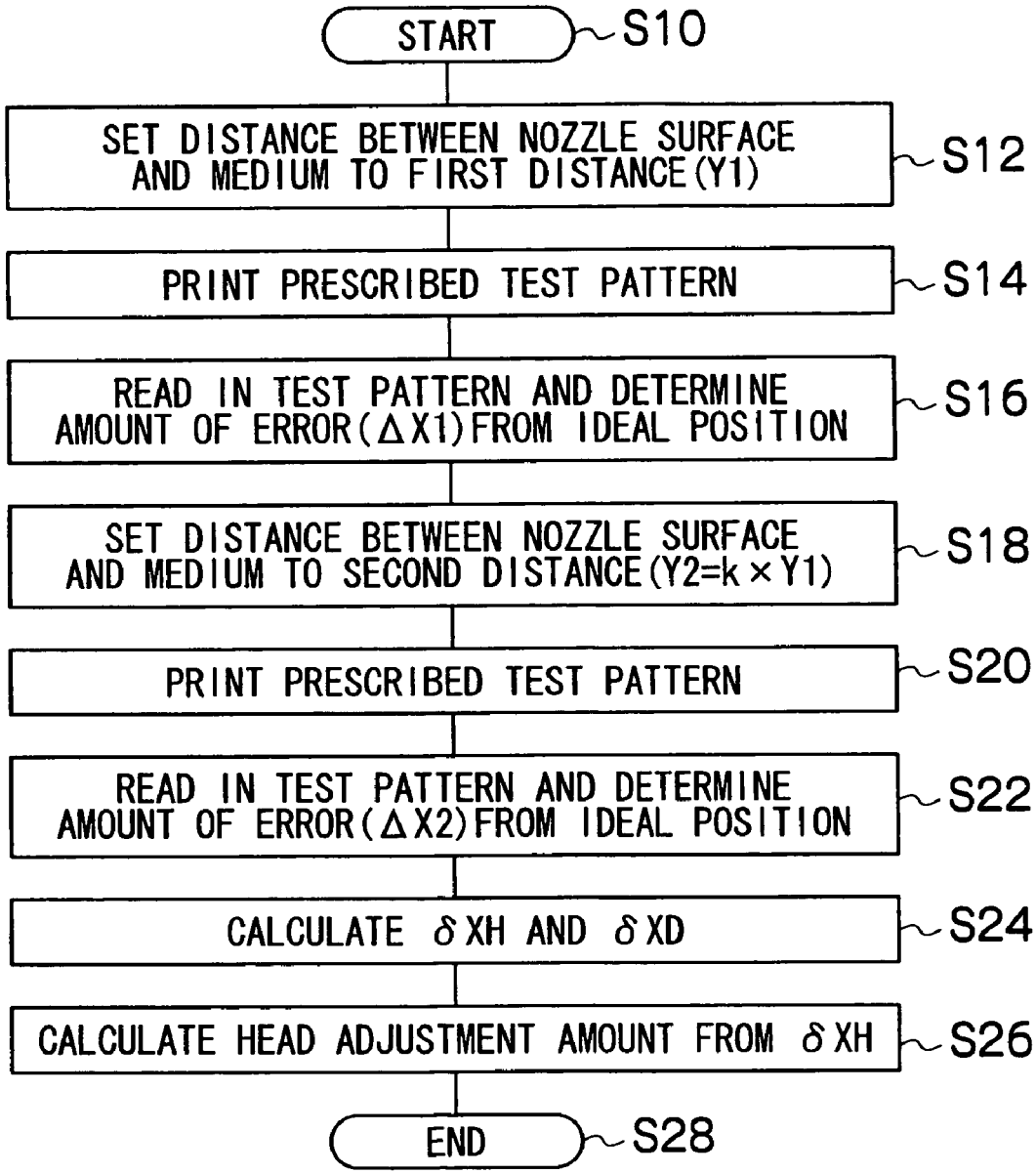
FIG. 10 is a flowchart showing a control procedure during measurement of a droplet deposition position error in the inkjet recording apparatus according to the first embodiment.

FIG. 10 is a flowchart showing a control sequence during measurement of a droplet deposition position error in an inkjet recording apparatus 110 according to the present embodiment.

There are no particular restrictions on the start timing of the droplet deposition position error measurement procedure shown in FIG. 10, and the start timing may be set to a wide variety of timings, such as when the apparatus is manufactured, when the head is replaced, when maintenance is performed, when the apparatus is started up, a prescribed timing based on control of the cumulative operating time, or a timing specified as needed by the operator, or the like.

When the droplet deposition position error measurement procedure starts (step S10), firstly, the distance between the nozzle surface and the medium is set to a first distance (Y1) (step S12), and then a prescribed test pattern is printed (step S14). The step of printing the (first) test pattern in step S14 corresponds to the "droplet ejection step" or the "first droplet ejection step".

Subsequently, the droplet deposition result of the test pattern printed in step S14 is read in, and the amount ΔX1 of error from the ideal position (i.e., $\Delta X1=X-X0$) is determined (step S16). The (first) measurement step of the amount of the error in step S16 corresponds to the "droplet deposition position error measurement step" or "first droplet deposition position error measurement step", and the amount (ΔX1) of the error corresponds to the "amount of droplet deposition position error" or the "amount of first droplet deposition position error".

The information relating to the first distance (Y1) obtained in step S12 and the information relating to the amount (ΔX1) of error obtained in step S16 is stored in a storage device, such as a memory.

Subsequently, the distance between the nozzle surface and the medium is adjusted to a second distance (Y2) (step S18). In this case, the second distance (Y2) is set to k times the first distance (Y1) (i.e., $Y2=k\times Y1$).

A prescribed test pattern (a test pattern based on the same drive control as that in step S14) is printed while this second distance (Y2) is maintained (step S20). The step of printing a (second) test pattern in step S20 corresponds to the "droplet ejection step" or the "second droplet ejection step".

Subsequently, the droplet deposition result of the test pattern printed in step S20 is read in, and the amount ΔX2 of error from the ideal position (i.e., $\Delta X2=X'-X0$) is determined (step S22). The (second) measurement step of the amount of the error in step S22 corresponds to the "droplet deposition position error measurement step" or the "second droplet deposition position error measurement step", and the amount (ΔX2) of the error corresponds to the "amount of droplet deposition position error" or the "amount of second droplet deposition position error".

The information relating to the second distance (Y2) in step S18 and the information relating to the amount (ΔX2) of error obtained in step S22 are stored in a storage device, such as a memory.

Subsequently, the values of δXH and δXD are calculated by resolving the equations of the above Formula 1 and Formula 2, on the basis of the information relating to the amounts of error (ΔX1 and ΔX2) obtained at step S16 and step S22 described above (step S24). The calculation step performed in step S24 corresponds to the "error cause separation step".

A head adjustment amount is determined on the basis of the δXH value obtained at step S24 (step S26), and the measurement process then terminates (step S28).

The head position is adjusted in accordance with the amount of head adjustment obtained by the aforementioned measurement sequence. Furthermore, the density correction coefficient is determined by using information on δXD obtained by the aforementioned measurement sequence.

Both the values of the δXH and the δXD are determined in the present embodiment; however, a mode is also possible in which only one of these values is calculated, and only the head installation position is adjusted or only the droplet ejection arrangement is corrected.

Second Embodiment

Next, a second embodiment of the present invention is described below.

Figure 11:
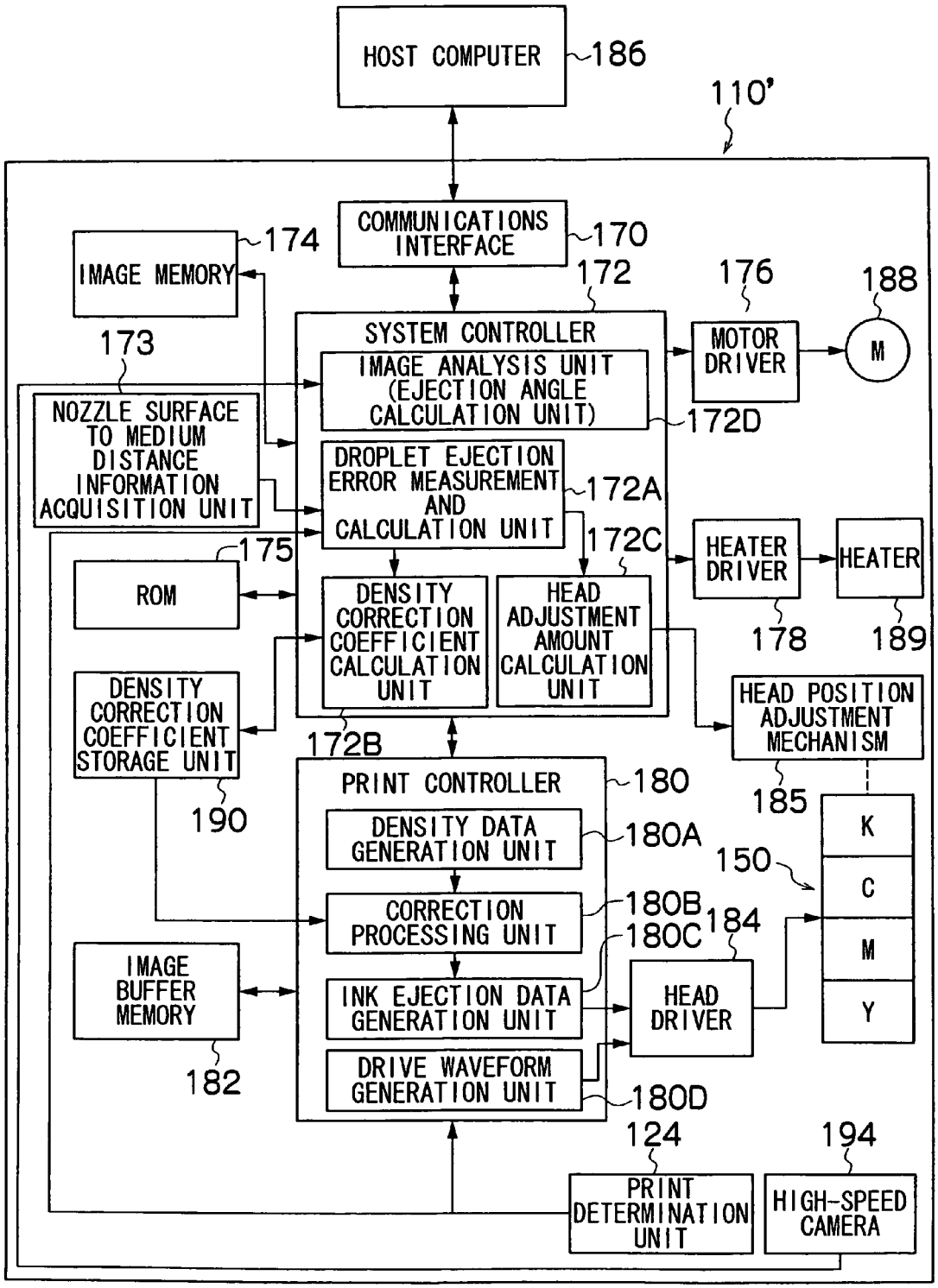
FIG. 11 is a principal block diagram showing the system configuration of the inkjet recording apparatus according to a second embodiment of the present invention.

FIG. 11 is a block diagram showing the composition of an inkjet recording apparatus according to a second embodiment of the present invention. In FIG. 11, elements which are the same as or similar to the composition in FIG. 9 are labeled with the same reference numerals and description thereof is omitted here.

The inkjet recording apparatus 110' shown in FIG. 11 is a constitutional example of a mode where the "Calculation method 2" is carried out, which is stated in the description of the "Principles of measurement" given above.

In other words, the inkjet recording apparatus 110' shown in FIG. 11 further comprises a high-speed camera 194 as a device which captures an image of the ejection state of each nozzle of the head 150. Furthermore, an image analysis unit 172D is provided in the system controller 172, as a device which analyzes the image signal obtained by the high-speed camera 194 and performs signal processing for calculating the ejection angle of a liquid droplet, and the like.

As the high-speed camera 194, a camera having a capture speed of approximately 100,000 frames/second is used, for example, with the object of capturing the flight of the liquid droplets propelled by the inkjet action. The image analysis unit 172D may be achieved by software or it may be composed by a special image processing IC. The value of δXD is calculated on the basis of the information on the ejection angle determined by the image analysis unit 172D, and the information on the nozzle surface to medium distance; and the value of δXH is calculated on the basis of this value of δXD and the above Formula 1.

In the case of the composition shown in FIG. 11, the combination of the high-speed camera 194 and the image analysis unit 172D corresponds to the "ejection direction measurement device", and the combination of the image analysis unit 172D and the droplet ejection error measurement and calculation unit 172A corresponds to the "error cause separation device".

Figure 12:
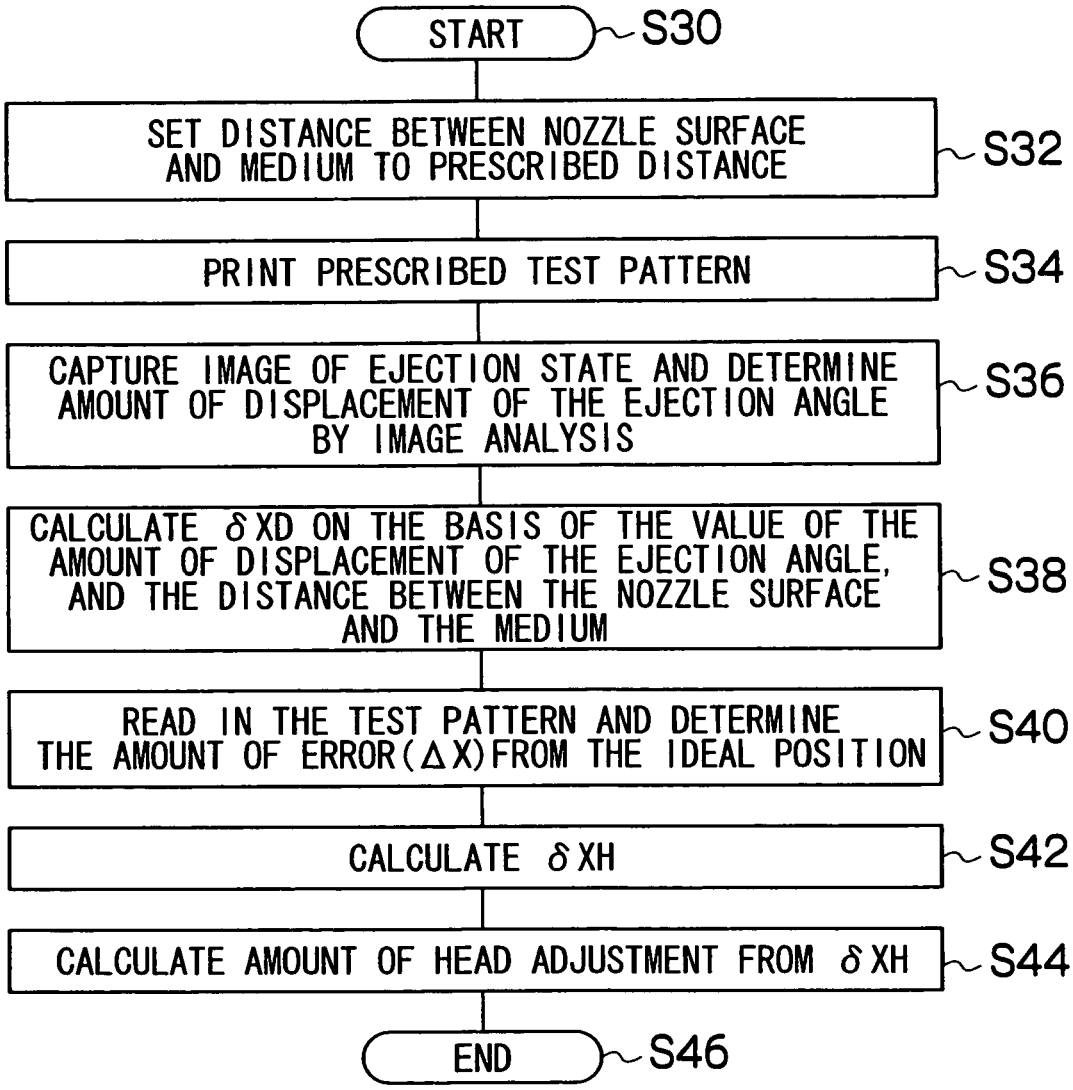
FIG. 12 is a flowchart showing a control procedure during measurement of a droplet deposition position error in the inkjet recording apparatus according to the second embodiment.
Figure 13:
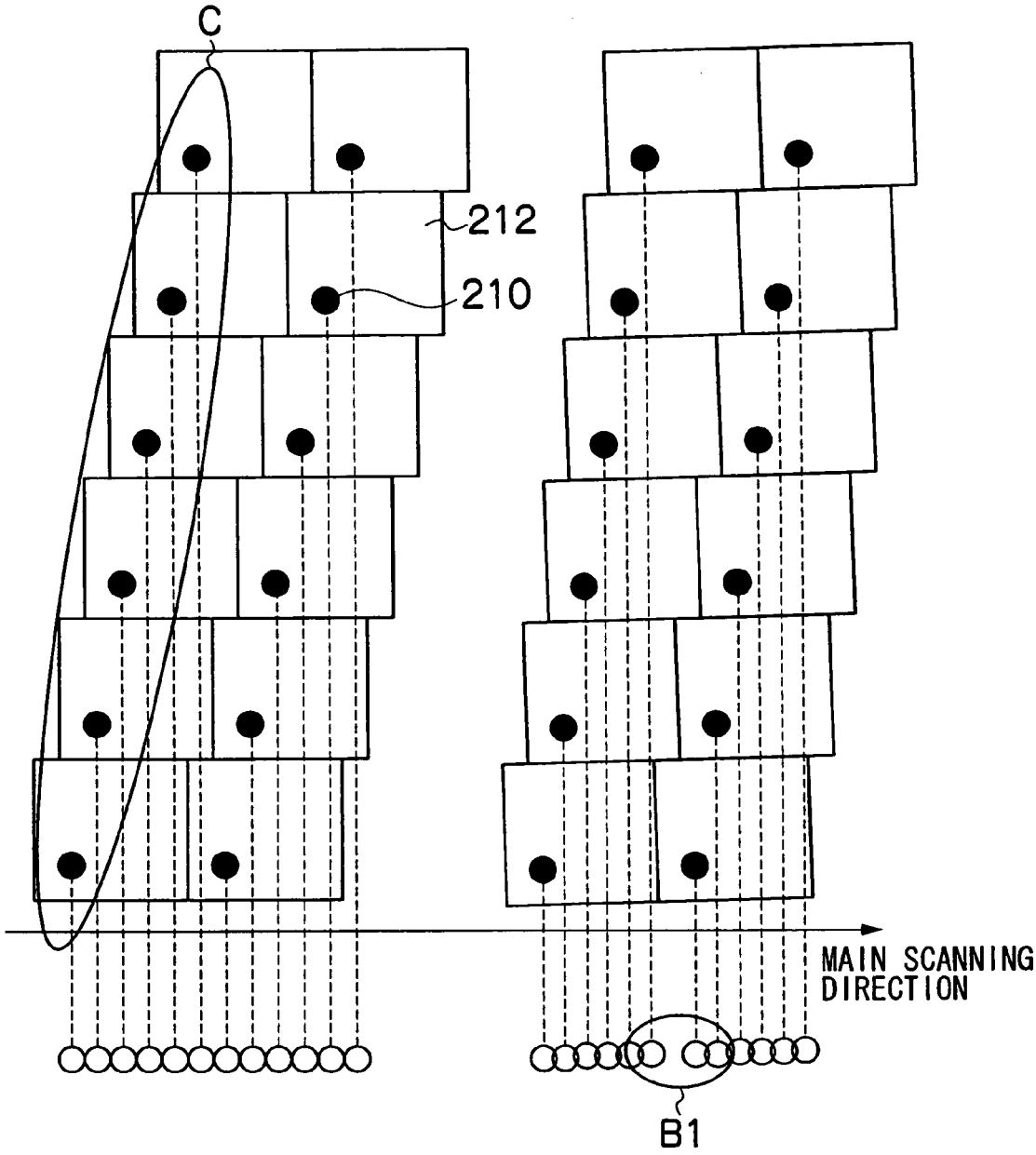
FIG. 13 is a schematic drawing for describing a phenomenon where a droplet deposition position error occurs due to an error in the installation angle of the matrix head; and FIG. 14A
Figure 14A:
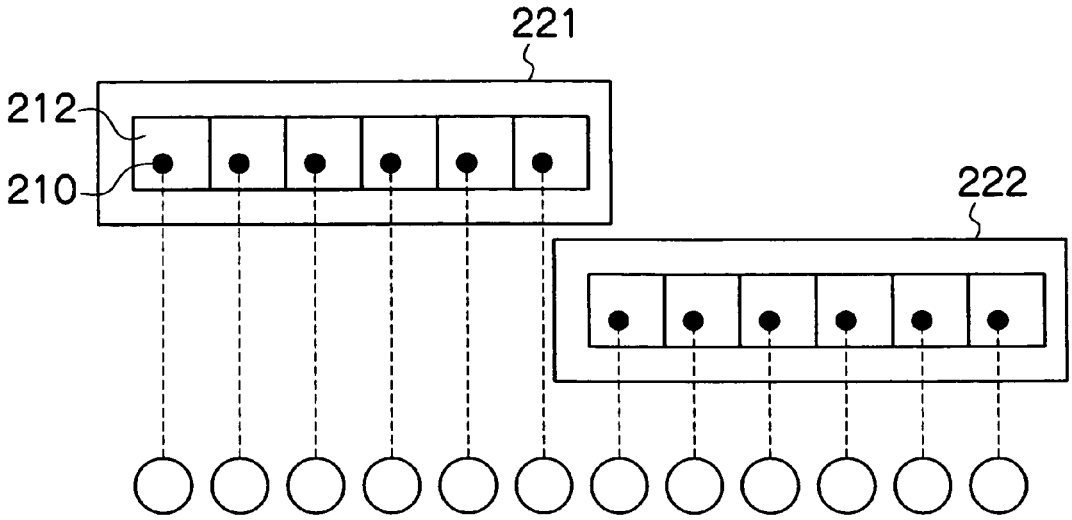
FIG. 14B is a schematic drawing for describing a phenomenon where a droplet deposition position error occurs due to an error in the installation position of short heads.
Figure 14B:
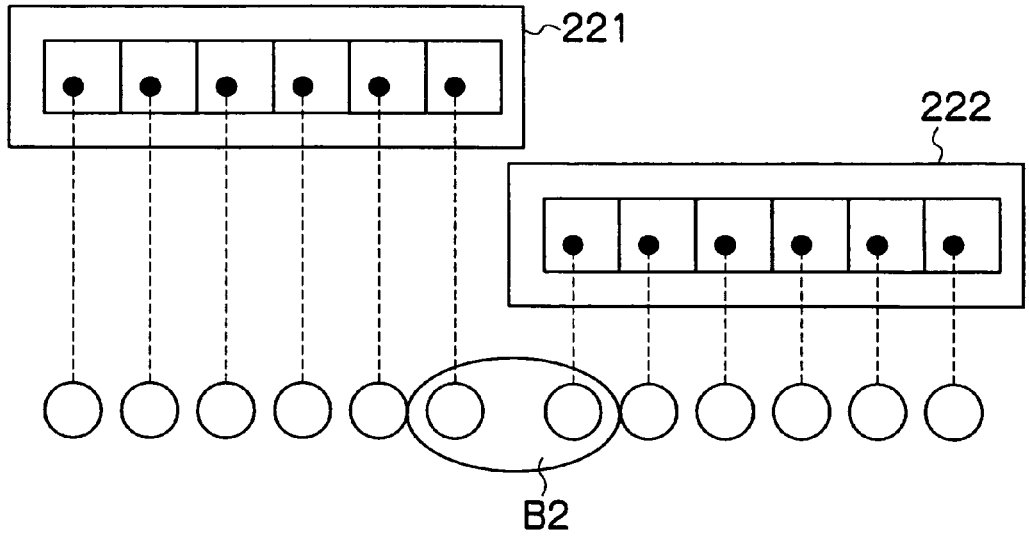

FIG. 12 is a flowchart showing a control sequence during the measurement of a droplet deposition position error in the inkjet recording apparatus 110' shown in FIG. 11.

There are no particular restrictions on the start timing of the droplet deposition position error measurement procedure shown in FIG. 12, and it may be set to a wide variety of timings, such as when the apparatus is manufactured, when the head is replaced, when maintenance is performed, when the apparatus is started up, a prescribed timing based on control of the cumulative operating time, or a timing specified as needed by the operator, or the like.

When the droplet deposition position error measurement procedure starts (step S30), firstly, the distance between the nozzle surface and the medium is set to a prescribed distance (for example, Y1) (step S32), and a prescribed test pattern is printed (step S34). The test pattern printing step in step S34 corresponds to the "droplet ejection step".

During the printing of the test pattern, the ejection state is captured by the high-speed camera 194 (see FIG. 11), the image data thus obtained (data indicating the flight paths of the liquid droplets) is analyzed, and the amount of displacement of the ejection angle is calculated (step S36 in FIG. 12). The step in step S36 corresponds to the "ejection direction measurement step".

Then, the component δXD of the droplet deposition position error caused by the ejection angle displacement is calculated on the basis of the value of the ejection angle displacement amount determined in step S36, and the value of the nozzle surface to medium distance obtained in step S32 (step S38).

Furthermore, the droplet deposition result of the test pattern printed in step S34 is read in, and the amount (ΔX) of the error from the ideal position is determined (i.e., $\Delta X = X - X0$) (step S40). The (first) error amount measurement step in step S40 corresponds to the "droplet deposition position error measurement step", and the amount of the error (ΔX) corresponds to the "amount of droplet deposition position error".

Subsequently, the value of δXH is calculated according to Formula 1, on the basis of the information on the error amount (ΔX) obtained in step S40 and the information on δXD obtained in step S38 (step S42). The calculation step performed in step S42 corresponds to the "error cause separation step".

A head adjustment amount is determined on the basis of the value of δXH obtained in step S42 (step S44), and the measurement process then terminates (step S46).

The head position is adjusted in accordance with the amount of head adjustment obtained by the aforementioned measurement sequence. Furthermore, the density correction coefficient is determined by using information on δXD obtained by the aforementioned measurement sequence.

Modification Embodiment 1

It is also possible to adopt a mode in which all or a portion of the functions carried out by the droplet ejection error measurement and calculation unit 172A, the density correction coefficient calculation unit 172B, the head adjustment amount calculation unit 172C, the image analysis unit 172D, the density data generation unit 180A, and the correction processing unit 180B shown in FIG. 9 or FIG. 11, are installed in the host computer 186.

Moreover, the application of the present invention is not limited to a line head type of printer, and embodiments of the present invention can also be applied effectively to a shuttle scanning type of printer.

Modification Embodiment 2

In the embodiments described above, an error in the relative position between the liquid ejection head and the recording medium is described in terms of an installation error of the head; however, apart from head installation error, the present invention may also be applied with respect to a droplet deposition position error due to the reproducible skewed travel or meandering travel of the medium caused by an installation error in the conveyance unit (for instance, if the belt which conveys the recording medium is installed with an inclination with respect to the head which is installed in a correct installation position), or the like. In this case, a device (mechanism) for adjusting the position of the conveyance device is provided instead of, or in combination with, the head position adjustment mechanism 185.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet deposition position error measurement method, comprising the steps of:

ejecting liquid droplets from a liquid ejection head including a plurality of liquid droplet ejection ports in such a manner that the liquid droplets are deposited on a recording medium;

determining an amount of a droplet deposition position error with respect to an ideal droplet deposition position on a recording surface of the recording medium, according to a droplet deposition result obtained from the liquid droplets on the recording medium;

separating a first error component caused by an error in a relative position between the liquid ejection head and the recording medium, and a second error component caused by an error in an ejection direction of each of the liquid droplet ejection ports, from the determined amount of the droplet deposition position error; and obtaining error information relating to at least one of the first and second error components.

2. A droplet deposition position error measurement method, comprising the steps of:

ejecting liquid droplets from a liquid ejection head including a plurality of liquid droplet ejection ports, toward a first recording medium situated at a first distance from an ejection surface of the liquid ejection head in such a manner that the liquid droplets are deposited on the first recording medium;

determining an amount of a first droplet deposition position error with respect to an ideal droplet deposition position on a recording surface of the first recording medium, according to a droplet deposition result obtained from the liquid droplets on the first recording medium;

ejecting liquid droplets from the liquid ejection head toward a second recording medium situated at a second distance, which is different from the first distance, from the ejection surface in such a manner that the liquid droplets are deposited on the second recording medium;

determining an amount of a second droplet deposition position error with respect to an ideal droplet deposition position on a recording surface of the second recording medium, according to a droplet deposition result obtained from the liquid droplets on the second recording medium; and performing calculation for separating a first error component caused by errors in relative positions between the liquid ejection head and each of the first and second recording media, and a second error component caused by an error in an ejection direction of each of the liquid droplet ejection ports, from the determined amounts of first and second droplet deposition position errors; and obtaining error information relating to at least one of the first and second error components.

3. A droplet deposition position error measurement method, comprising the steps of:

ejecting liquid droplets from a liquid ejection head including a plurality of liquid droplet ejection ports in such a manner that the liquid droplets are deposited on a recording medium;

determining an amount of a droplet deposition position error with respect to an ideal droplet deposition position on a recording surface of the recording medium, according to a droplet deposition result obtained from the liquid droplets on the recording medium;

measuring an ejection direction of the liquid droplet ejected from each of the liquid droplet ejection ports;

separating a first error component caused by an error in a relative position between the liquid ejection head and the recording medium, and a second error component caused by an error in the ejection direction of each of the liquid droplet ejection ports, from the determined amount of the droplet deposition position error, according to information on the measured ejection direction; and obtaining error information relating to at least one of the first and second error components.

4. A droplet deposition position error adjustment method, comprising the steps of:

obtaining error information relating to a first error component according to the droplet deposition position error measurement method as defined in claim 1; and adjusting the relative position between the liquid ejection head and the recording medium according to the obtained error information relating to the first error component in such a manner that the first error component is corrected.

5. A droplet deposition position error adjustment method, comprising the steps of:

obtaining error information relating to a first error component according to the droplet deposition position error measurement method as defined in claim 2; and adjusting the relative position between the liquid ejection head and the recording medium according to the obtained error information relating to the first error component in such a manner that the first error component is corrected.

6. A droplet deposition position error adjustment method, comprising the steps of:

obtaining error information relating to a first error component according to the droplet deposition position error measurement method as defined in claim 3; and adjusting the relative position between the liquid ejection head and the recording medium according to the obtained error information relating to the first error component in such a manner that the first error component is corrected.

7. A droplet ejection control method, comprising the steps of:

obtaining error information relating to a second error component according to the droplet deposition position error measurement method as defined in claim 1; and controlling liquid ejection by the liquid ejection head according to the obtained error information relating to the second error component in such a manner that visibility of unevenness on a recorded image caused by the second error component is reduced.

8. A droplet ejection control method, comprising the steps of:

obtaining error information relating to a second error component according to the droplet deposition position error measurement method as defined in claim 2; and controlling liquid ejection by the liquid ejection head according to the obtained error information relating to the second error component in such a manner that visibility of unevenness on a recorded image caused by the second error component is reduced.

9. A droplet ejection control method, comprising the steps of:

obtaining error information relating to a second error component according to the droplet deposition position error measurement method as defined in claim 3; and controlling liquid ejection by the liquid ejection head according to the obtained error information relating to the second error component in such a manner that visibility of unevenness on a recorded image caused by the second error component is reduced.

10. An image forming apparatus, comprising:

a liquid ejection head in which a plurality of liquid droplet ejection ports are formed;

a droplet ejection control device which implements control for causing liquid droplets to be ejected from the liquid ejection head in such a manner that the liquid droplets are deposited on a recording medium;

a droplet deposition position error measurement device which reads in positions of dots recorded on the recording medium, and determines an amount of a droplet deposition position error with respect to an ideal droplet deposition position on a recording surface of the recording medium;

an error cause separation device which separates a first error component caused by an error in a relative position between the liquid ejection head and the recording medium, and a second error component caused by an error in an ejection direction of each of the liquid droplet ejection ports, from the amount of the droplet deposition position error determined by the droplet deposition position error measurement device;

an adjustment amount calculation device which calculates an amount of adjustment for the relative position between the liquid ejection head and the recording medium in such a manner that the first error component is corrected, according to error information relating to the first error component separated by the error cause separation device; and a position adjustment device which adjusts the relative position between the liquid ejection head and the recording medium according to the amount of adjustment calculated by the adjustment amount calculation device.

11. An image forming apparatus, comprising:

a liquid ejection head in which a plurality of liquid droplet ejection ports are formed;

a droplet ejection control device which implements control for causing liquid droplets to be ejected from the liquid ejection head in such a manner that the liquid droplets are deposited on a recording medium;

a droplet deposition position error measurement device which reads in positions of dots recorded on the recording medium, and determines an amount of a droplet deposition position error with respect to an ideal droplet deposition position on a recording surface of the recording medium;

an error cause separation device which separates a first error component caused by an error in a relative position between the liquid ejection head and the recording medium, and a second error component caused by an error in an ejection direction of each of the liquid droplet ejection ports, from the amount of the droplet deposition position error determined by the droplet deposition position error measurement device;

a droplet ejection arrangement determination device which determines a droplet ejection arrangement to be performed by the liquid ejection head, according to error information relating to the second error component separated by the error cause separation device, in such a manner that visibility of unevenness on a recorded image caused by the second error component is reduced.

12. The image forming apparatus as defined in claim 10, further comprising an ejection direction measurement device which measures the ejection direction of the liquid droplet ejected from each of the liquid droplet ejection ports, wherein the error cause separation device performs calculation for separating the first error component and the second error component, from the amount of the droplet deposition position error determined by the droplet deposition position error measurement device, by using information relating to the ejection direction measured by the ejection direction measurement device.

13. The image forming apparatus as defined in claim 11, further comprising an ejection direction measurement device which measures the ejection direction of liquid droplet ejected from each of the liquid droplet ejection ports, wherein the error cause separation device performs calculation for separating the first error component and the second error component, from the amount of the droplet deposition position error determined by the droplet deposition position error measurement device, by using information relating to the ejection direction measured by the ejection direction measurement device.

* * * * *